US005614042A

United States Patent [19]

Nishide et al.

[11] Patent Number: 5,614,042

[45] Date of Patent: Mar. 25, 1997

[54] TAPE BINDING DEVICE FOR ELECTRIC WIRE BUNDLE AND TAPE BINDING METHOD

[75] Inventors: Yutaka Nishide; Takahiro Fujioka, both of Osaka; Ricardo K. Yoshida, Yokkaichi, all of Japan

[73] Assignees: Sumitomo Electric Indus.; Sumitomo Wiring Systems, Ltd., Osaka, Japan

[21] Appl. No.: 352,219

[22] Filed: Dec. 2, 1994

[30] Foreign Application Priority Data

Dec. 6, 1993 [JP] Japan ..... 5-305570

[51] Int. Cl.[6] ..... B65B 13/14; B65B 41/06; B65H 81/06; B65H 81/08

[52] U.S. Cl. ..... 156/53; 53/137.2; 53/399; 53/419; 53/586; 53/590; 100/10; 100/16; 156/215; 156/489; 156/490; 156/520; 156/538

[58] Field of Search ..... 156/184, 187, 156/193, 353, 354, 355, 443, 489, 486, 392, 53, 215, 490, 520, 538; 53/586, 137.2, 399, 419, 590; 29/755; 100/10, 16, 20, 21, 7, 2

[56] References Cited

U.S. PATENT DOCUMENTS

| | | | |
|---|---|---|---|
| 1,991,281 | 2/1935 | Johnson | 156/490 X |
| 2,873,564 | 2/1959 | Bogeskov | 53/586 X |
| 3,092,016 | 6/1963 | Nebout et al. | 100/7 |
| 3,535,189 | 10/1970 | Hall et al. | 53/586 X |
| 3,627,300 | 12/1971 | Caveney et al. | 53/590 X |
| 4,351,684 | 9/1982 | Gibbons et al. | 156/486 X |
| 5,063,803 | 11/1991 | Panneri et al. | 53/586 |

FOREIGN PATENT DOCUMENTS

| | | |
|---|---|---|
| 456144 | 11/1991 | European Pat. Off. . |
| 59-12052 | 1/1984 | Japan . |
| 59-64477 | 4/1984 | Japan . |
| 59-90377 | 5/1984 | Japan . |
| 60-163307 | 8/1985 | Japan . |

*Primary Examiner*—Michael W. Ball
*Assistant Examiner*—Francis J. Lorin
*Attorney, Agent, or Firm*—Beveridge, DeGrandi, Weilacher & Young, L.L.P.

[57] ABSTRACT

The present invention discloses a tape binding device winding a tape piece having an adhesive surface on one side around an electric wire bundle to bundle it. In the device, a pair of arms having a holding surface are lowered while holding the tape piece cut into a predetermined length on the holding surface. As it is lowered, free ends of both arms are lowered to both sides separated by a top portion of the electric wire bundle. At the time of lowering, after winding the tape piece by pressing it around a surface of the electric wire bundle, the free ends of both arms make adhesive surfaces of both ends of the tape piece under the electric wire bundle to adhere each other and are clipped between them, thereby laminating adhesive surfaces each other.

14 Claims, 21 Drawing Sheets

TAPE BINDING DEVICE FOR ELECTRIC WIRE BUNDLE AND TAPE BINDING METHOD

FIELD OF THE INVENTION

The present invention relates to a tape binding device used for bundling a plurality of electric wires in the production process of wire harnesses, etc., and a tape binding method.

DESCRIPTION OF RELATED ART

The production process of a with harness consisting of various kinds of insulated electric wires bundled to each other includes an electric wire measuring/cutting step, a peeling step for peeling an insulative sheath at the end of the electric wire, a terminal crimping step for crimping a terminal fitment at the end of the peeled electric wire, a terminal insertion step for inserting a terminal into a connector housing, and a subassembling step for assembling electric wires to assemble wire harness subassemblies.

The production process has conventionally been performed manually, recently, however, a mechanical device for automating the respective steps have been proposed, one of which is an automated wire laying out device for performing a part of the wire cutting step and subassembling step.

The automated wire laying out device is constructed such that a wire lay-out head for paying out electric wires moves relatively to a wire lay-out board wherein a wire lay-out pin is provided at a predetermined position according to a predetermined program. That is, for example, the wire lay-out head is moved parallel to the wire lay-out board and the electric wires paid out are wound around the wire lay-out pin at the time of moving, thereby laying out the electric wire in the predetermined pattern.

After wires are laid out, the end of the electric wire is peeled and a desired terminal is crimped, and then the terminal is inserted into a connector housing. In this way, wire harness subassemblies constituting a portion of a wire harness are produced. Similarly, various kinds of wire harness subassemblies constituting the wire harness are produced. The wire harness subassembly produced via laying out of wires on the wire lay-out board is temporarily removed from the wire laid-out board. Then, various kinds of wire harness subassmeblies are further assembled in a predetermined embodiment and then subjected to a main assembling step to obtain a wire harness assembly as a finished product.

The wire harness subassembly is, for example, composed of about 25 electric wires. Therefore, if the wire harness subassembly is removed from the wire lay-out board, the electric wires constituting the wire harness subassembly are taken to pieces. Thus, if the same kinds of wire harness subassemblies are collected in one location, electric wires constituting different wire harness subassemblies may be intertwined each other. For this reason, there was a problem of a poor workability in assembling wire harness subassemblies by collecting the same type of wire harness subassemblies individually.

In order to solve this problem it may be considered to tape a key portion in the state where a plurality of electric wires are laid out on the wire lay-out board. As a matter of course, it is desirable to automate such a taping from the viewpoint of automating the production of wire harness subassemblies.

However, in order to tape the key portion of electric wires laid out complicatedly on the wire lay-out board, a mechanical device which can enter into a narrow space between electric wires laid out and wind a tape on the electric wire bundle will be required.

Tape winding devices which have hitherto been proposed for producing a wire harness are, for example, disclosed in Japanese Patent Unexamined Publication Nos. 59-12052, 59-64477, 59-90377 and 60-163307. However, in these devices, a bobbin wound with an adhesive tape is rotated around an electric wire bundle, and then the tape is paid out from the bobbin sequentially to wind it around the electric wire bundle. Therefore, a large space is required for rotating the bobbin around the electric wire bundle, and a structure itself is large.

Thus, the above prior art is suitable for taping to coat the whole wire harness after the completion of a main assembly operation, but is not suitable for taping the key portion of the electric wire bundle laid out on the wire lay-out board. For this reason, the above taping treatment had to rely conventionally on manual operations.

SUMMARY OF THE INVENTION

It is an object of the present invention to provide a tape binding device which can solve above technical problems and bind an electric wire bundle with a tape by winding the tape around the electric wire bundle in a narrow space, and a tape binding method.

In order to accomplish the above object, one embodiment of the present invention directs to a tape binding device for binding an electrical wire bundle with a tape piece having an adhesive to surface on one side, comprising:

a device body;

a pair of arms provided vertically movable to said device body, having a mutually attachable/detachable free end, respectively;

a holding surface provided on said the respective arms so as to be continuous with said free end to hold said tape piece;

a biasing means for biasing said free ends of said arms to bring into contact with each other;

a tape piece holding means for holding said tape piece with a predetermined holding strength while contacting the other surface of said tape piece with said holding surfaces of said arms; and an arm moving means for moving said arms vertically with respect to said device body.

According to this embodiment, after causing a tape piece to be held onto the holding surface of a pair of arms, arms are then lowered from the upper side of the electric wire bundle. At the time of this lowering, the tape piece is covered around the electric wire bundle while pressing it by the free end. Then, the pair of arms are further lowered, thereby clipping both ends of the tape piece in the state where adhesive surfaces at both ends of the tape piece are adhered to each other at the lower side of the electric wire bundle by the free end at the time of this lowering to laminate adhesive surfaces to each other. The winding can be conducted in a considerably narrow space in comparison with a conventional type device wherein a bobbin is rotated. As a result, it becomes possible to automatically tape the key portion of the electric wire bundle laid out on the wire lay-out board.

Another embodiment of the present invention directs to a tape binding method for binding an electric wire bundle a with tape piece having an adhesive surface on one side an comprising the steps of:

holding the adhesive surface onto holding surfaces respectively continuous with free ends of a pair of arms by placing the adhesive surface downward; and lowering the free ends to both sides separated by a top portion of the electric wire bundle;

wherein the step for lowering the free ends includes a step of covering the tape piece around the electric wire bundle while pressing the tape piece on the electric wire bundle by the free end at the time of lowering, and clipping both ends of the tape piece in a state where adhesive surfaces at both ends of the tape piece are adhered to each other under the electric wire bundle by the free end at the time of further lowering to laminate adhesive surfaces to each other.

According to this embodiment, the taping can be conducted in a considerably narrow space in comparison with a conventional type device wherein a bobbin is rotated. As a result, it becomes possible to automatically tape the key portion of the electric wire bundle laid out on the wire lay-out board.

BRIEF DESCRIPTION OF THE DRAWINGS

FIGS. 1A and 1B are perspective views illustrating a key portion of the tape binding device of one embodiment of the present invention, wherein FIG. 1A illustrates a state of arms receiving tape piece from a tape piece supplying mechanism, and FIG. 1B illustrates a state of arms covering a tape piece onto an electric wire bundle.

FIG. 7A illustrates an unclamping state and FIG. 7B illustrates a state of the tape to be clamped.

FIG. 20 is a schematic perspective view illustrating the tape binding mechanism, wherein

DETAILED DESCRIPTION OF THE PREFERRED EMBODIMENTS

The following Examples further illustrate the present invention in detail with reference to the accompanying drawings.

Whole Construction

Figure 4:
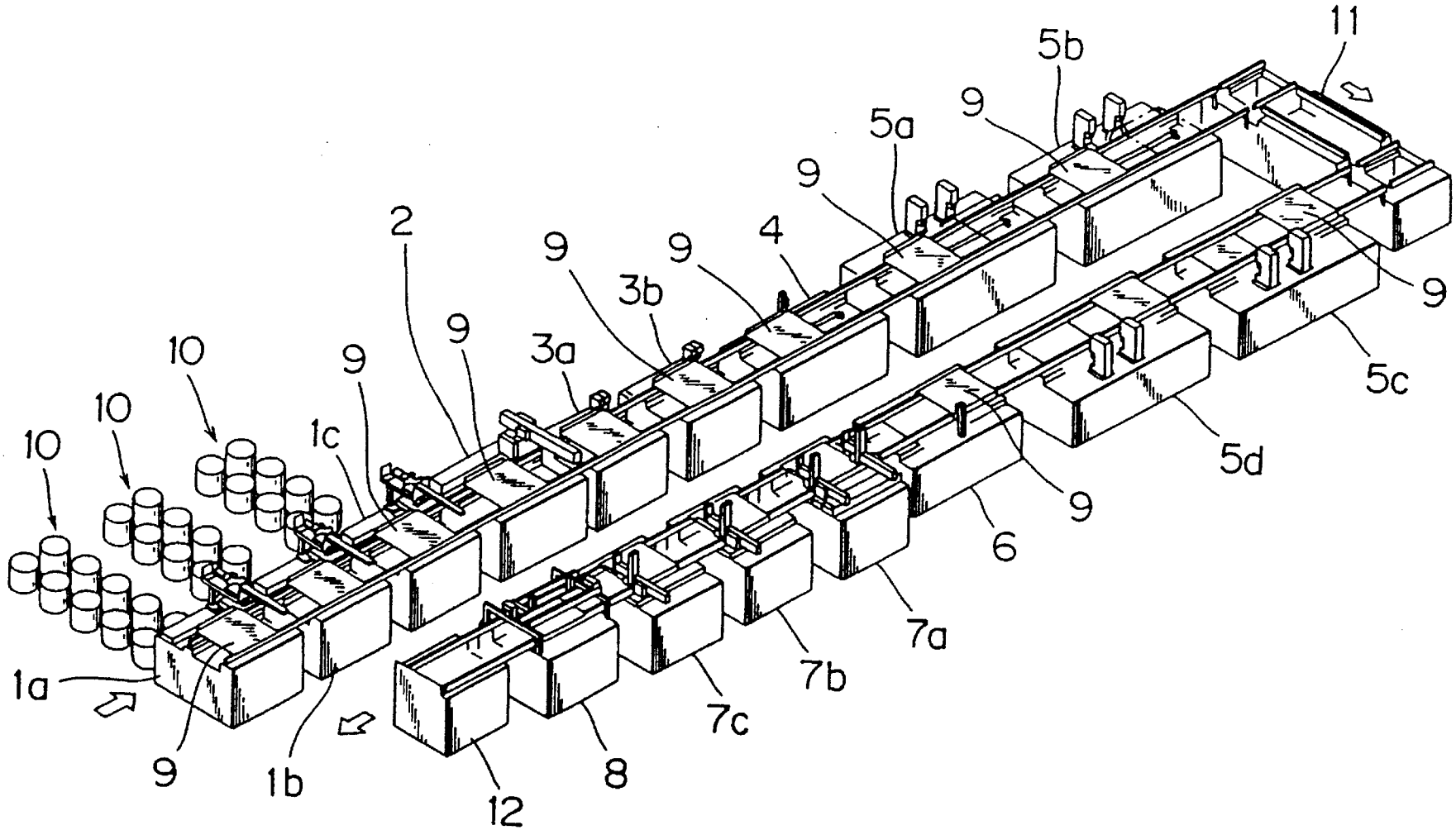
FIG. 4 is a schematic perspective view illustrating a whole construction of a wire harness production system using the automated taping module.

FIG. 4 is a general perspective view illustrating a construction of the production system of a wire harness incorporated with a tape binding device of one embodiment of the present invention. This production system has a construction wherein devices modularized for every step are coupled in such an arrangement that each step contains a predetermined number of the modularized devices.

More specifically, this production system is composed of 1) three automatic wire laying out modules 1*a*, 1*b* and 1*c* (referred to as "automatic wire laying out modules 1" en block hereinafter), 2) an automatic taping module 2 as a tape binding device of one embodiment of the present invention, 3) two stripping modules 3*a*, 3*b* (referred to as "stripping modules 3" en block hereinafter), 4) a stripping check module 4, 5) four terminal crimping modules 5*a*, 5*b*, 5*c* and 5*d* (referred to as "terminal crimping modules 5" en block hereinafter), 6) a terminal check module 6, 7) three terminal inserting modules 7*a*, 7*b* and 7*c* (referred to as "terminal inserting modules 7" en blocked hereinafter), and 8) a conductivity checking module 8, all of which are serially coupled in this order.

When a wire harness is produced by this production system, a predetermined wire lay-out board 9 is successively carried from module to module along a flow from the automatic wire laying out modules 1*a* toward the conductivity checking module 8 so as to build up wiring harness on the wire lay-out board 9.

The automatic wire laying out modules 1 are devices for automatically laying out electric wires with measured length on the wire lay-out board 9. Specified kinds of electric wire group 10 involved in the laying out are stored in the vicinity of the automatic wire laying out modules 1. Electric wires of the electric wire group 10 are selectively incorporated in the automatic wire laying out modules 1, laid out on the wire lay-out board 9, and then cut with measured length.

The wire lay-out board 9, after wires are laid out by the automatic wire laying out modules 1, is carried to the automatic taping modules 2, and a bundle of the electric wires laid out on the wire lay-out board 9 is taped up in predetermined positions so as not to untidy.

The wire lay-out board 9 is carried to the stripping modules 3, where the predetermined length of an insulative sheath at the end of each wires is removed and the wire cores are exposed. Then the wire lay-out board 9 is carried to the stripping checking module 4.

The stripping inspection module 4 is, for example, provided with a checking camera for determining acceptance/rejection of the stripping process according to the photographed images. That is, it is conducted to check if the insulative sheath is completely removed, if the stripped end of the electric wire is bent or untidy, and so forth.

There are four of the terminal crimping modules 5 connected in series downstreamwise from the stripping check module 4. The respective terminal crimping modules 5 are used for crimping of various kinds of terminals. Between the second terminal crimping module 5*b* and the third terminal crimping module 5*c*, a conveyor-buffer module 11 is inserted. In the conveyor-buffer module 1, a timing of carrying the wire lay-out board 9 toward the third terminal crimping module 5*c* is adjusted.

The crimping check module 6 is coupled downstreamwise from the terminal crimping modules 5. The crimping check module 6 has, for example, a check camera to determine acceptance/rejection of the terminal crimping process by taking a picture of the vicinity of the end of the electric wire and subjecting the resulting image to a predetermined treatment. That is, it is conducted to check if the terminal is properly crimped, if the end of the electric wire is bent abnormally, and so forth.

The wire lay-out board 9 is carried to the terminal inserting modules 7 after checking of the crimping. The terminal inserting modules 7 are devices for automatically inserting the terminal crimped at the end of the electric wire into a connector housing. The respective terminal crimping modules 7*a*, 7*b* and 7*c* insert different kinds of terminals.

The conductivity checking module 8 is coupled downstreamwise from the terminal inserting module 7. In the conductivity checking module 8, a checking coupler is connected to the connector housing into which the terminal is inserted to conduct a conductivity check to the electric wire used for the laying out.

A buffer module 12 is coupled downstreamwise from the conductivity checking module 8, and the wire lay-out board 9 carried to the buffer module 12 is transferred to the next production step because the required processing in this production line is completed.

By means of such production systems, a wire harness assembly constituting a wire harness is obtained. Through the main assembling operation wherein multiple kinds of wire harness subassemblies are fabricated to be arranged into the respective kinds of wire harness subassemblies, a complete wire harness is obtained.

Incidentally, the respective modules do not necessarily perform the same operation but apply different treatments against a plurality of wire lay-out boards 9 according to the predetermined program thereby various kinds of wire harness subassemblies constituting a wire harness are produced in turn and carried to the buffer module 12. Therefore, by sequentially removing the wire harness subassemblies on the wire lay-out boards 9 carried to the buffer module 12 and conducting a main assembling operation, a complete product of a wire harness can be obtained. That is, different production lines are not necessarily required for the respective wire harness subassemblies, but various kinds of wire harness subassemblies are produced in a production line.

In order to apply different treatments to the respective wire lay-out boards 9, it may be conducted to form numbers or symbols corresponding to the wire harness subassembly to be formed on the wire lay-out board 9 on the back surface of the wire lay-out board 9 to read symbols or the like, thereby causing the respective modules to conduct program operation.

A wire harness subassembly remains a fixed shape when held onto a wire lay-out board 9, but if the subassembly is removed from the wire lay-out board 9, it does not retain its shape and a plurality of wires may be untidy or electric wires belonging to different wire harness subassemblies may be mutually intertwined. In order to prevent such inconveniences, an automatic taping module 2 connected downstreamwise from the automatic wire laying out modules 1 is provided.

Figure 3:
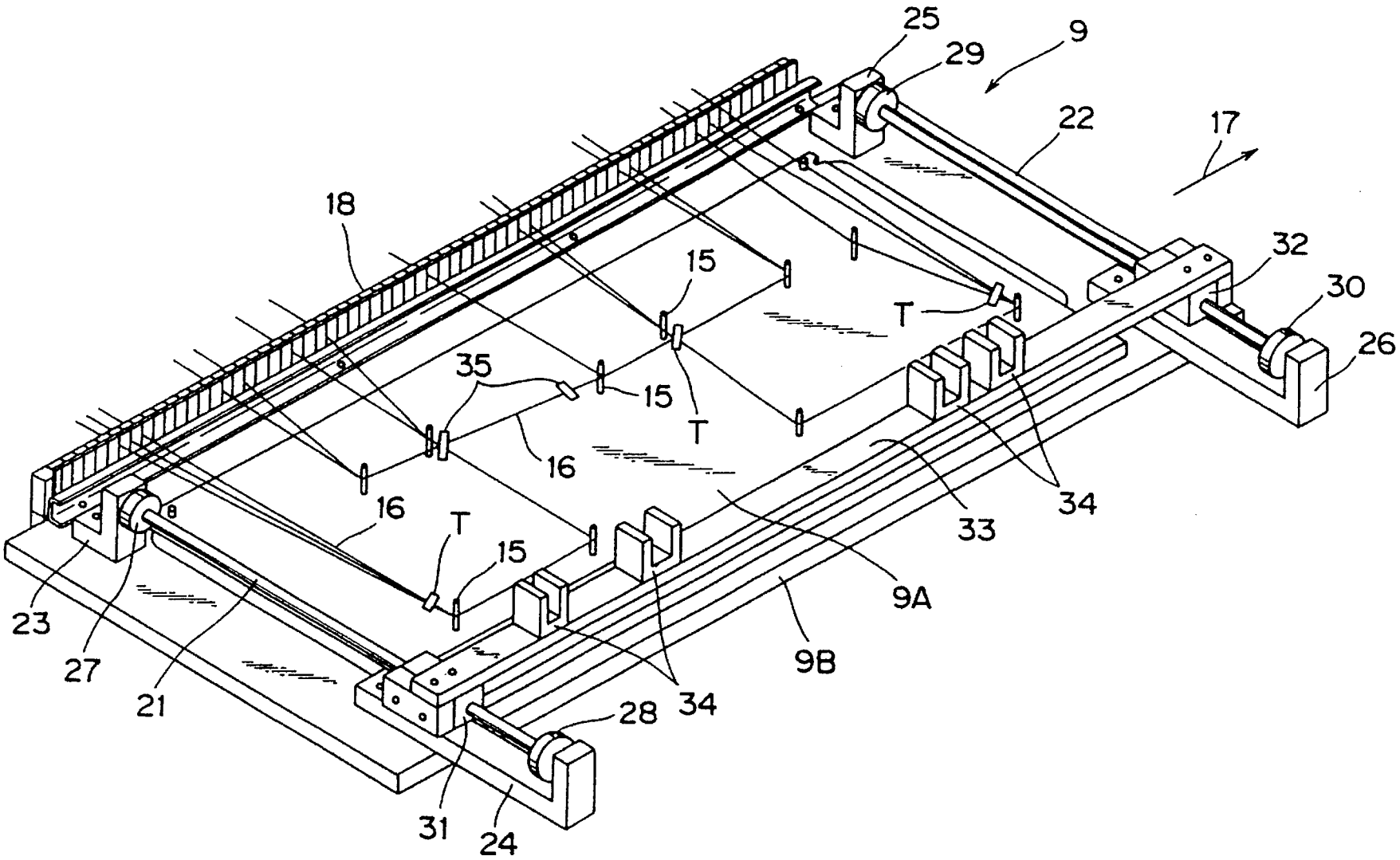
FIG. 3 is a schematic perspective view illustrating a wire lay-out board for explaining the taping operation.

FIG. 3 is a schematic diagram for illustrating the automatic taping module 2 and a state wherein the electric wire laid out on the wire lay-out board 9 is subjected to a taping treatment. The wire lay-out board 9 is provided with a pin board 9A on which the wire lay-out pins 15 is disposed vertically, and a base plate 9B to hold this pin board. The wire lay-out pins 15 are disposed vertically on the location corresponding to the desired lay-out patterns, and the automatic wire laying out modules 1 lay the electric wires 16 by winding the electric wires 16 around the wire lay-out pins 15.

In the base plate 9B, one side edge following the transportation direction 17 of the wire lay-out board 9 is provided with an electric wire clamp 18 capable of holding the end of the electric wire 16 at a predetermined distance. Further, at one end and the other end concerning with the transportation direction 17, a pair of mutually parallel guide rods 21, 22 is provided, the pin board 9A being interposed between them. The guide rods 21, 22 are held at a constant level from the surface of the base plate 9B by means of supporting members 23, 24, 25 and 26, both ends of the supporting member having approximately L-shape.

In guide rods 21, 22, slide members 31, 32 are inserted slidably, respectively. Between this pair of slide members 31, 32, a housing holding rod 33 is held parallel to the electric wire clamp 18. On a predetermined location of the housing holding rod 33, approximately U-shaped holding members 34 are provided to hold a connector housing (not shown). Shock absorbing members 27, 28, 29 and 30 of urethane resin are fitted into both ends of the guide rods 21, 22, which reduce the impact of the slide members 31, 32 at the time of collision.

The housing holding rod 33 is maintained at a location avoiding the space over the pin board 9A so as not to inhibit wire laying out and taping treatments until the treatment by means of the automatic taping module 2 is completed as shown in FIG. 3. Prior to the treatment by means of the terminal inserting modules 7, it is located in the vicinity of the electric wire clamp 18 by sliding the slide members 31, 32 along the guide rods 21, 22. In the terminal inserting module 7, the electric wires 16 are removed sequentially from the electric wire clamp 18 and the terminal crimped to the tip end of the electric wires 16 (not shown) are inserted into the connector housing held by the holding member 34 (not shown).

In the automatic taping module 2, the wire harness subassemblies on the wire lay-out board 9 are temporarily held at the key portions by means of a tape T. That is, in order to prevent the electric wires 16 from becoming untidy or mutually intertwining themselves when they are removed from the wire lay-out board 9, a plurality of electric wires 16 are mutually taped at predetermined positions resulting in a temporarily taped state.

Figure 2:
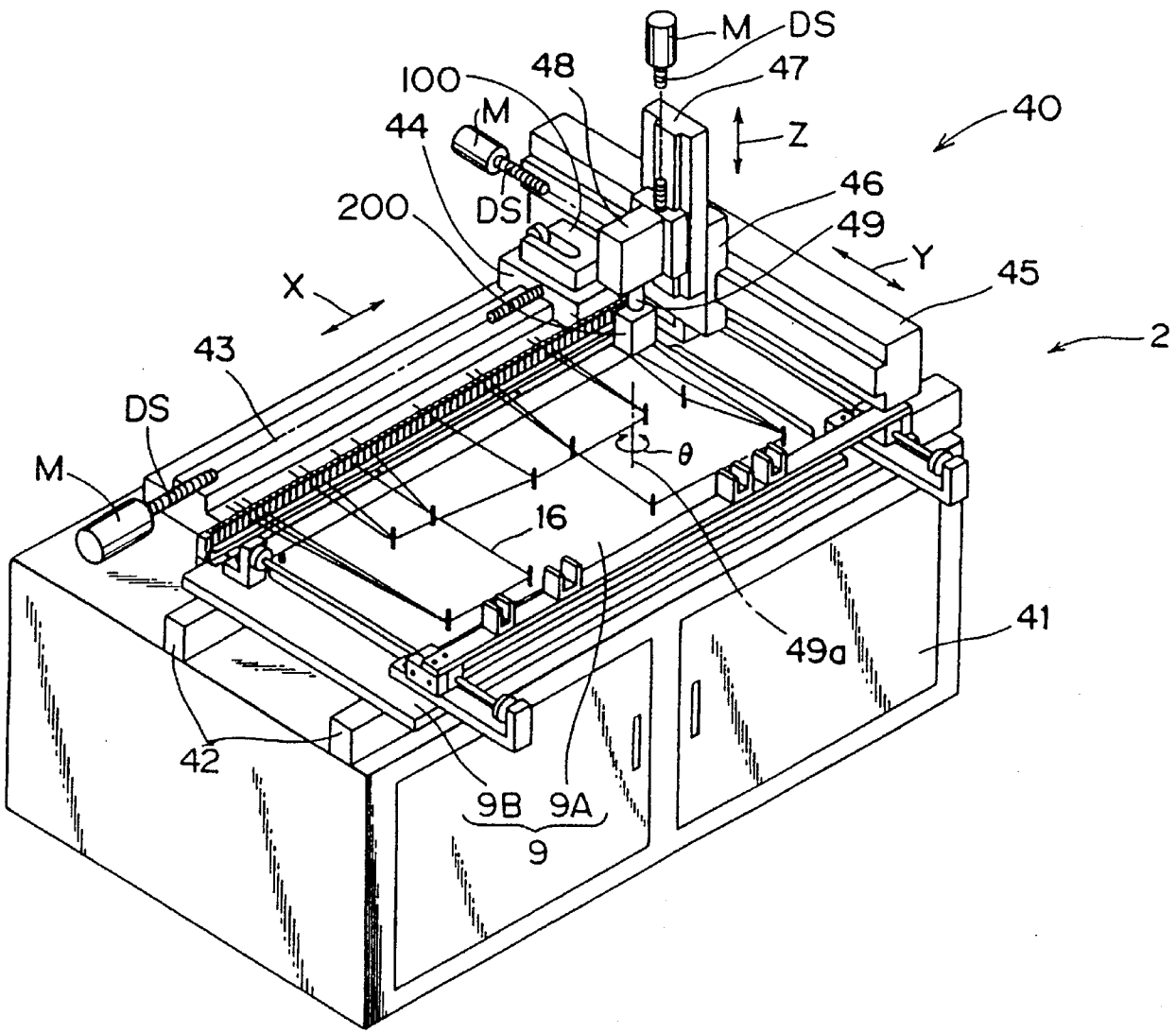
FIG. 2 is a schematic perspective view illustrating an automated taping module as a tape binding device.

FIG. 2 is a perspective view illustrating the whole construction of the automatic taping module 2. The automatic taping module 2 is a tape binding device provided with 1) a base 41, 2) a tape binding mechanism 200 which bundles a tape piece onto the electric wire bundle, 3) a moving mechanism 45 held on the base 41 to move the tape binding mechanism 200 to the required location of the upper part of the base 41, and 4) a tape piece supplying mechanism 100 held on the base 41 to supply the tape piece to the tape binding mechanism 200 and the like.

Referring to FIG. 2, rails 42 for guiding a base plate 9B of the wire lay-out board 9 is provided on the base 41. On the rails 42, the wire lay-out board 9 is located and fixed by means of a fixing mechanism (not shown), and the taping treatment is also conducted. The rails 42 correspond to the holding section of the wire lay-out board.

In the base 41, the guide rail 43 is provided on the location which is oppose to one side edge of the wire lay-out board 9. A X-direction moving holder 44 moving in the X-direction is provided slidably on this guide rail 43. The moving holder 44 is fixed with a guide member 45 extending in the Y-direction intersected perpendicularly to the X-direction within a horizontal surface. Further, a tape piece supplying mechanism 100 for supplying the tape piece of a specified length is fixed thereon.

The guide member 45 is provided slidably with the Y-direction moving holder 46, the removing holder 46 being fixed with a guide member 47 extending in the Z-direction as a perpendicular direction. This guide member 47 is provided slidably with a Z-direction moving holder 48 which is provided with a tape binding mechanism 200 via an axis 49. A rotating drive mechanism (not shown) which causes the tape binding mechanism 200 to rotate in the direction around the axial line 49*a* of the axis 49 are provided in the interior of the Z-direction moving holder 48.

The respective moving holders 44, 46, 48 are driven in the X-, Y-, and Z-directions by means of a feed screw mechanism DS driven by the motor M. The conveyor in the X-, Y- and Z-directions and the rotation related to the θ direction of the tape binding mechanism 200 are conducted according to the predetermined programs executed by a control means (not shown). Thereby, the tape binding mechanism 200 shifts in the X-, Y-, and Z-directions and revolves in the θ direction to change its direction. Then, the electric wires 16 are temporarily taped by the tape T at the predetermined positions, thus the taping treatment shown in FIG. 3 is accomplished.

As described above, in this embodiment, there is constructed the moving mechanism 40 for moving the tape binding mechanism 200 to the predetermined position on the wire laid-out board 9, which includes the above-described guide rail 43, X-direction moving holder 44, guide member 45, Y-direction moving holder 46, guide member 47, Z-direction moving holder 48, feed screw mechanism DS and motor M. Further, the X-direction moving holder 44 also functions as a holding member of a tape supplying mechanism 100.

Figure 1A:
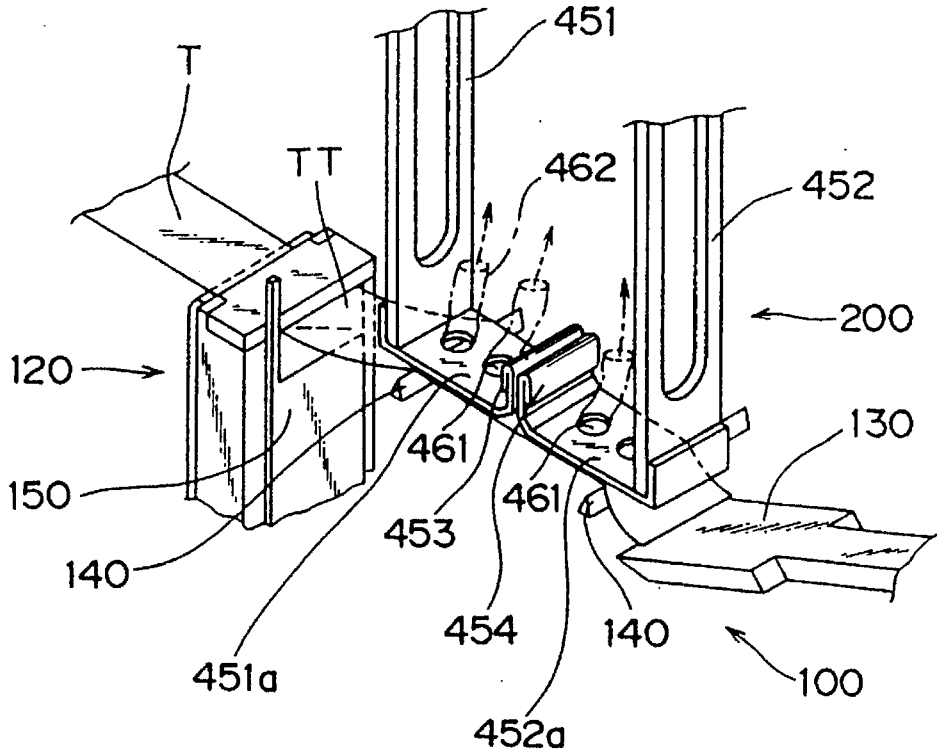
Figure 1B:
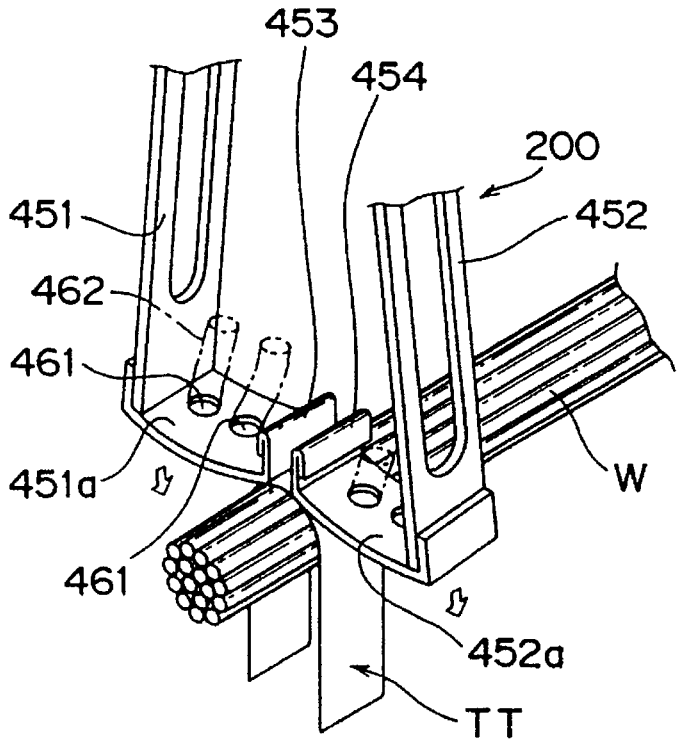

This embodiment is characterized by, as shown in FIG. 1A, 1) receiving a tape piece TT held by means of a tape supporting member 140 between a tape clamp mechanism 120 of a tape piece supplying mechanism 100 and a tape end holding member 130 by air suction by means of a plate-like pressing part 451*a*, 452*a* of a pair of arms 451, 452 of a tape binding mechanism 200 and as shown in FIG. 1B, 2) moving the tape piece to the predetermined position while holding it with arms 451, 452 and 3) lowering the respective arms 451,452 to both sides separated from the tip portion of the electric wire bundle W, to wind the tape piece TT around the electric wire bundle W.

Tape Piece Supplying Mechanism

Figure 5:
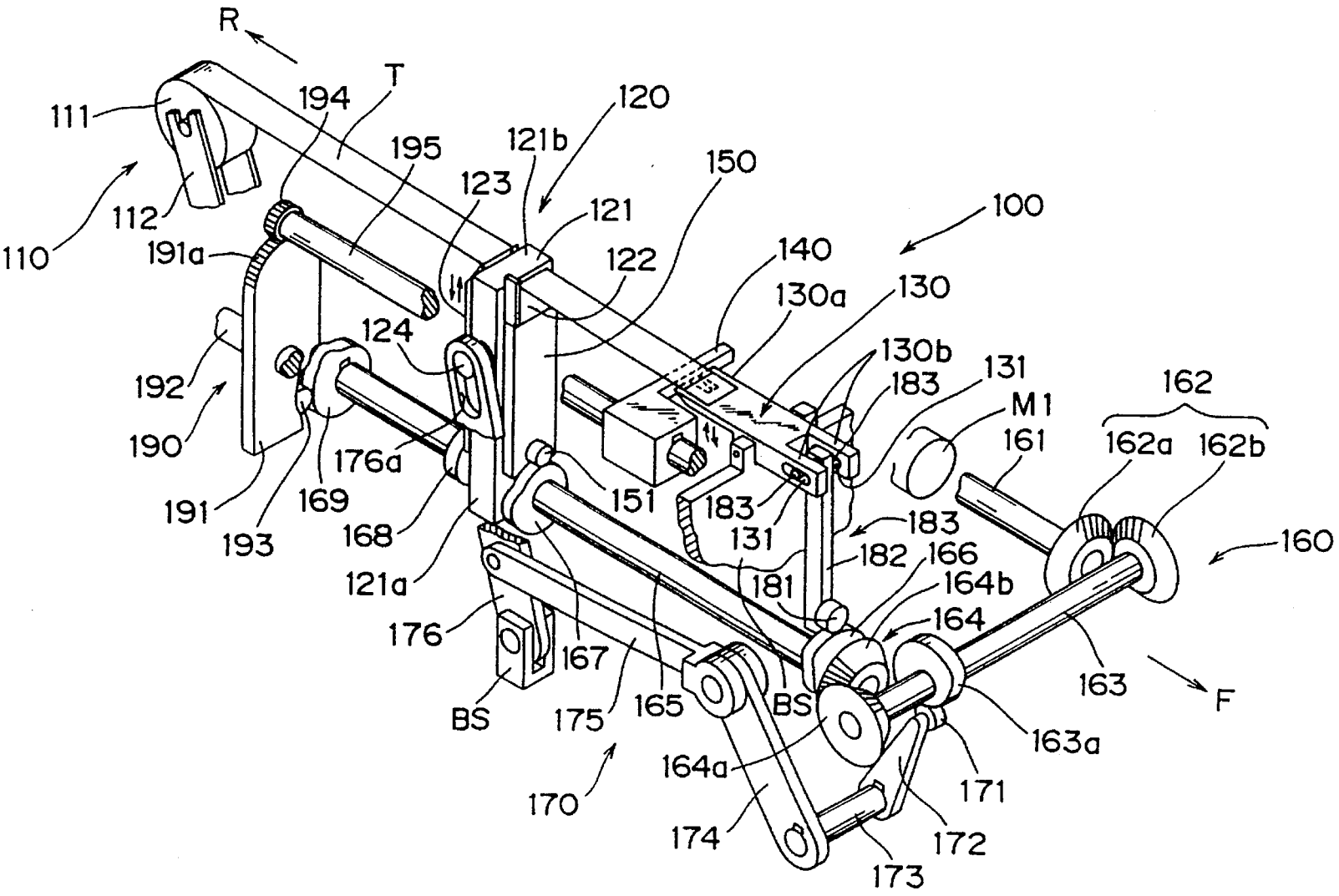
FIG. 5 is a schematic perspective view illustrating a construction of a tape piece supplying mechanism of the tape binding mechanism

FIG. 5 is a perspective view illustrating a schematic construction of the tape piece supplying mechanism 100. Referring to the same drawing, this tape piece supplying mechanism 100 includes 1) a tape drawing mechanism 110 for drawing the tape from a rotation roll 111 which has wound a tape having an adhesive surface on one side, 2) a tape clamping mechanism 120 for clamping the end of the tape T drawn from the rotation roll 111 and removing between the forward position (F-direction is called forward in FIG. 5) and the backward position (R-direction is called backward in the same drawing), 3) a tape end holding member 130 for receiving and holding the end of the tape T from the tape clamping mechanism 120 held rockably in the base section BS and moved to the forward position, 4) a tape supporting member 140 which supports the tape T extended between the tape end holding member 130 and the tape clamping mechanism 120 which have moved to the backward position in the straight state from the lower direction, 5) a tape cutting member 150 for cutting the tape T at a position in the vicinity of the tape clamping mechanism 120 provided in the backward position and 6) a driving mechanism 160 which drives in synchronization with the clamping mechanism 120, the tape end holding member 130, the tape supporting member 140 and the tape cutting member 150.

Tape Drawing Mechanism

Figure 6:
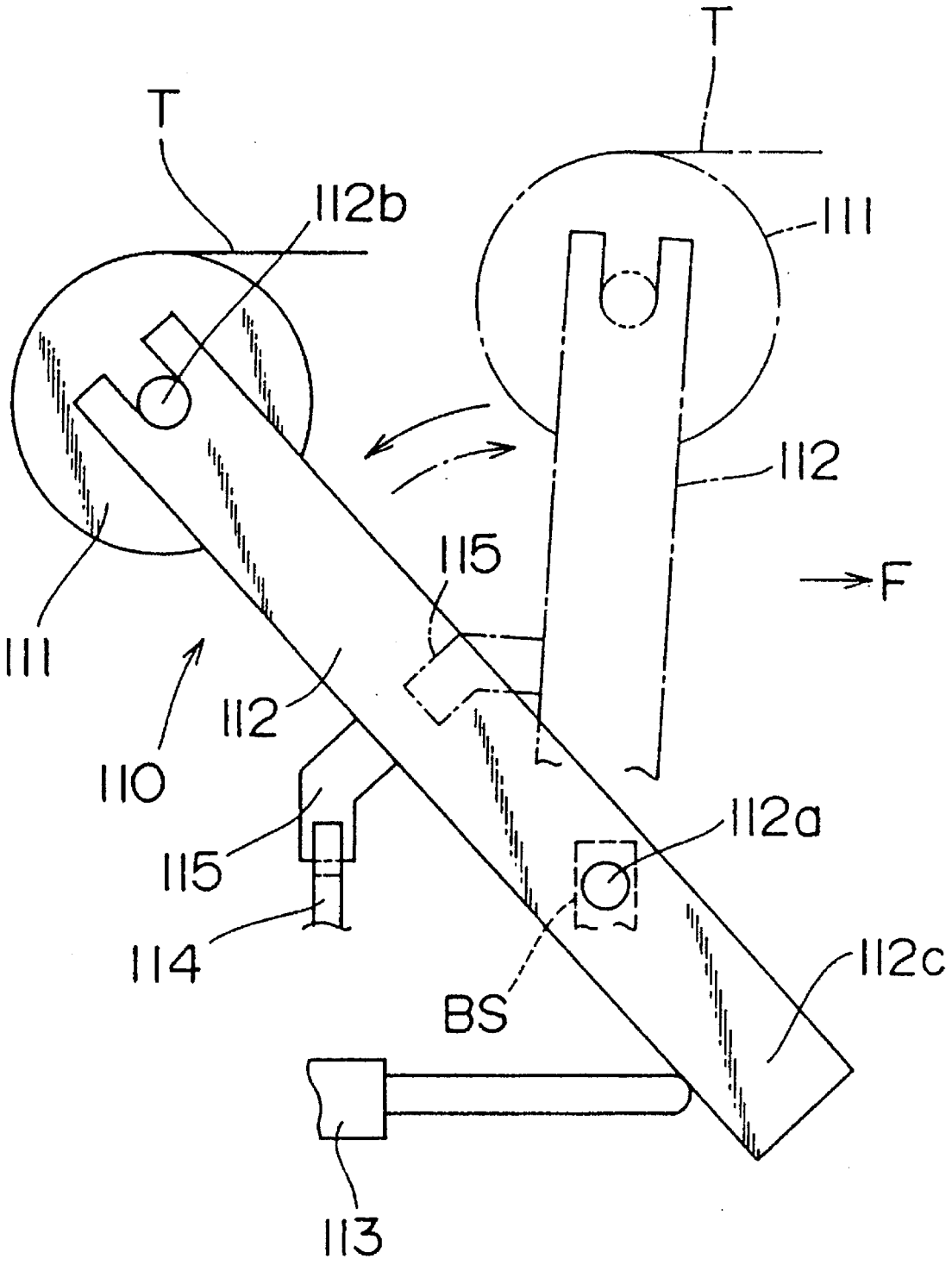
FIG. 6 is a schematic lateral view illustrating a tape drawing mechanism among tape piece supplying mechanisms.

Referring to FIG. 6, the tape drawing mechanism 110 includes 1) a supporting lever 112 mounted rockably to the base section BS thereto centering on the predetermined position 112*a* in the vicinity of the lower end thereof, 2) an air cylinder 113 as a driving means for inclining the supporting lever 112 backwards to draw the tape T by pushing the supporting lever 112 at its lower end 112*c* and 3) a photomicrosensor 114 provided on the rear portion of the supporting lever 112, as a tape ending checking means for detecting the tape T wound around the rotating roll 111 reaching the end.

The center rear portion of the supporting lever 112 is provided with a sensor dog 115 for operating the photomicrosensor 114.

When the air cylinder 113 operates (see solid line in FIG. 6), the tape clamping mechanism 120 provided on the rear position thereof clamps and stops the end portion of the tape T. On the other hand, when the tape clamping mechanism 120 moves forward, the backwardly inclining supporting lever 112 is, along with this movement, stretched forward via the tape T in confrontation with its own weight, and raises itself until it erects approximately, as shown by one-point line. Since the tape T has been drawn out of the rotating roll 111 before the tape clamping mechanism 120 moves forward for measuring, the tape clamping mechanism 120 does not confront non-required resistance in its forward moving.

Furthermore, when the tape clamping mechanism 120 moves forward if the tape T on the rotating roll 111 has come to its roll end, the supporting lever 112 inclines backward by its own weight since it is not stretched forward as shown in FIG. 6 As a result the photomicrosensor 114 is blocked with the sensor dog 115, thus the photomicrosensor 114 turns ON, thereby stopping the bundling device, and the replacement time of the rotating roll 111 is informed via buzzers, etc.

Tape Clamping Mechanism

Figure 7A:
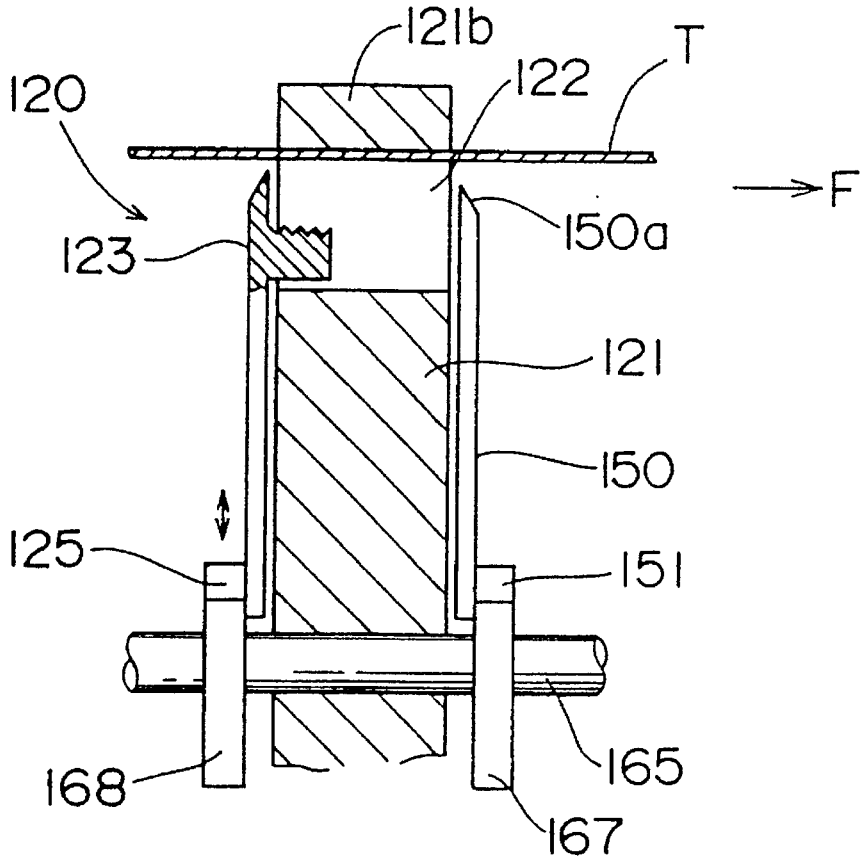
FIGS. 7A and 7B are partial sectional lateral views illustrating a tape clamping mechanism among tape piece supplying mechanisms, where
Figure 7B:
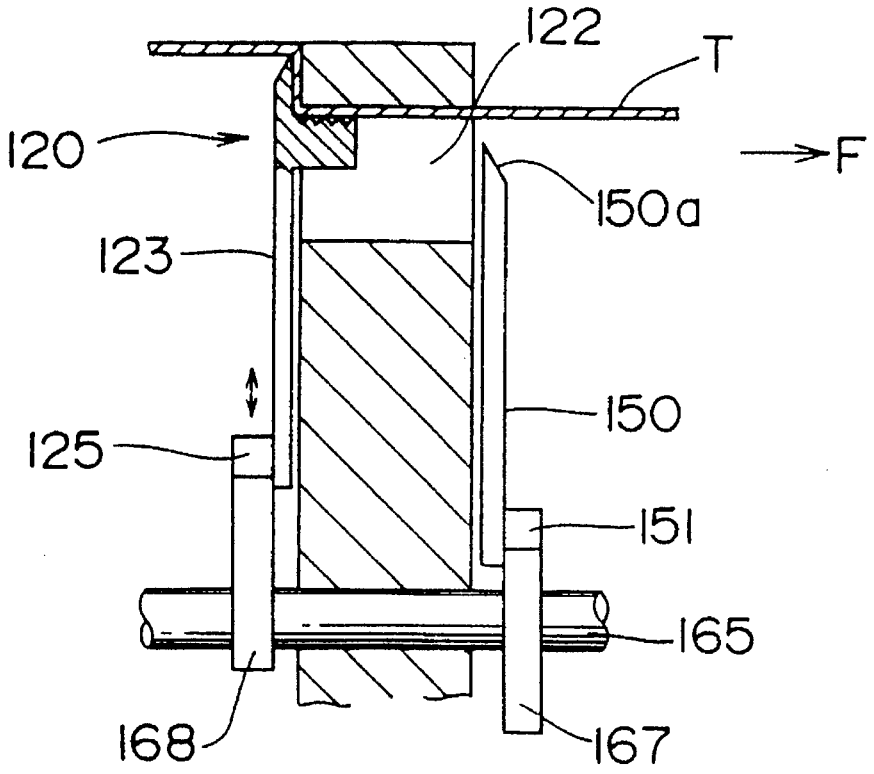

Referring to FIGS. 5, 7A and 7B, the tape clamping mechanism 120 includes 1) a plate member 121 having a lower end 121*a* which is mutually rotatable and moves forward/backward mounted to a third conveying axis 165 to be described later of the driving mechanism 160 and having an upper end 121*b* with a tape inserting hole 122 in angular section, and 2) a clipping plate 123 provided vertically movable on the plate member 121 along its back surface, where slipping of the tape T occurs at the upper position between it and the rear side at the upper rim of the tape inserting hole 122, as shown in FIG. 7B. On the other hand, the clipping plate 123 permits the tape T to move through the tape inserting hole 122 at the lower position shown in FIG. 7A.

Referring to FIG. 5, a cylindrical locking projection 124 which locks up with the locking hole 176*a* in the rocking lever 176 to be described later of the driving mechanism 160 is formed on the lateral side of the plate member 121. Referring to FIGS. 7A, 7B, a cam follower 125 composed of a cylindrical projection following a tape clamping cam 168 of the driving mechanism 160 to be described later is formed at the lower portion of the clipping plate 123.

Tape End Holding Member

Referring to FIG. 5, the tape end holding member 130 is mounted rotatably to the base section BS around the rotation axis line at the central part thereof. The upper surface of one end of the tape end holding member 130 functions as a tape end holding member 130*a* for holding the end of the tape T with its adhesive force. Further, the other end of the tape supporting member 130 is formed into a channel form containing a pair of projections 130*b*. The respective projections 130*b* are provided with a long hole section 131. A pin 183 formed on the end of the operation lever 182 contained in the tape end holding cam-link mechanism 180 to be described later of the driving mechanism 160 is inserted into the long hole section 131, respectively.

Tape Supporting Member

Referring to FIG. 5, the tape supporting member 140 is composed of a rocking lever provided on the fourth conveying axis 195 of the driving mechanism 160 in an integrally rotatable way, and a pair rocking levers are provided with the predetermined distant apart (only one of them is shown in the drawing).

Tape Cutting Member

Referring to FIGS. 5 and 7A, the tape cutting member 150 is composed of the plate member provided along the front surface of the plate member 121 of the tape clamping mechanism 120 in a vertically movable way and a cutter edge 150*a* is formed on the upper surface. On the lower portion of the tape cutting member 150, a cam follower 151 composed of the cylindrical projection following a tape cutting cam 167 to be described later of the driving mechanism 160 is formed. The tape cutting member 150 can be moved forward/backward together with the tape clamping mechanism 120. The tape cutting member 150 cuts the tape at the position along the front surface of the plate member 121 by the movement in the upper direction.

Driving Mechanism

Referring to FIG. 5, the driving mechanism 160 includes 1) a motor M as a drive source, 2) a first conveying axis 161 driven by the motor M, 3) a second conveying axis 163 drive-joined via the first bevel gear mechanism 162 with the first conveying axis 161 and 4) the first bevel gear mechanism 162 and a third conveying axis 165 drive-joined via the second conveying axis 163 and the second bevel gear mechanism 164.

The second conveying axis 163 is mounted in an integrally rotatable way with a reciprocating cam 163*a* for moving forwardly/backwardly the tape clamping mechanism 120 and the tape cutting member 150 via a reciprocating cam-link mechanism 170.

The third conveying axis 165 is mounted in an integrally rotatable way with 1) a tape end holding cam 166 for rocking the tape end holding member 130 via the tape end holding cam-link mechanism 180, 2) a tape cutting cam 167 for vertically moving the tape cutting member 150 via the cam follower 151, 3) a tape clamping cam 168 for vertically moving the clipping plate 123 via the cam follower 125 and 4) a tape supporting cam 169 for rocking the tape supporting member 140 via a tape supporting cam-gear mechanism 190 between the supporting position and the non-supporting position.

The reciprocating cam-link mechanism 170 includes 1) a cam follower 171 following the reciprocating cam 163*a*, 2) a rocking lever 172 having a base end supported rotatably with one end of an axis 173 and a tip end supporting the cam follower 171 rotatably, 3) a rocking lever 174 having one end supported integrally rotatable to the other end of the axis 173 and 4) an operation lever 182 having a lower end supported rotatable to the base section BS and an upper end formed with the locking hole 176*a*, which is coupled with the rocking lever 174 via a coupling level 175.

The tape end holding cam-link mechanism 180 includes a cam follower 181 following the tape holding cam 166 and the operation lever 182 supporting rotatably the cam follower 181 at the lower end. The pin 183 is formed protectively on the side surface opposing to the upper end of the operation lever 182.

The tape supporting cam-gear mechanism 190 includes 1) a cam follower 193 following the tape supporting cam 169, 2) an operation lever 191 fixing the cam follower 193 on the lower end and forming a gear section 191*a* on the upper end surface, which is supported rotatably around the axis 192 of the approximately center portion and 3) a gear 194 which engages with the gear section 191*a* of the operation lever 191 and includes a gear 194 rotating integrally with the fourth conveying axis 195. Incidentally, the axis 192 and the fourth conveying axis 195 are supported rotatably to the base section, respectively.

Tape Binding Mechanism

Referring to FIGS. 8 to 11, the tape binding mechanism 200 will be explained. This tape binding mechanism 200 includes 1) a frame 300 fixed to the moving holder 48 at the upper end thereof and 2) a winding mechanism 400 held to the frame 300. This winding mechanism 400 includes 1) a pair of electric wire bundle clamping mechanisms 410, 420 clamping electric wires at the time of tape winding to hold them, 2) an air cylinder 430 mounted the frame 300 as a lifting means and 3) a lifting section 435 lifted by means of this air cylinder 430.

Electric Wire Bundle Mechanism

Figure 12:
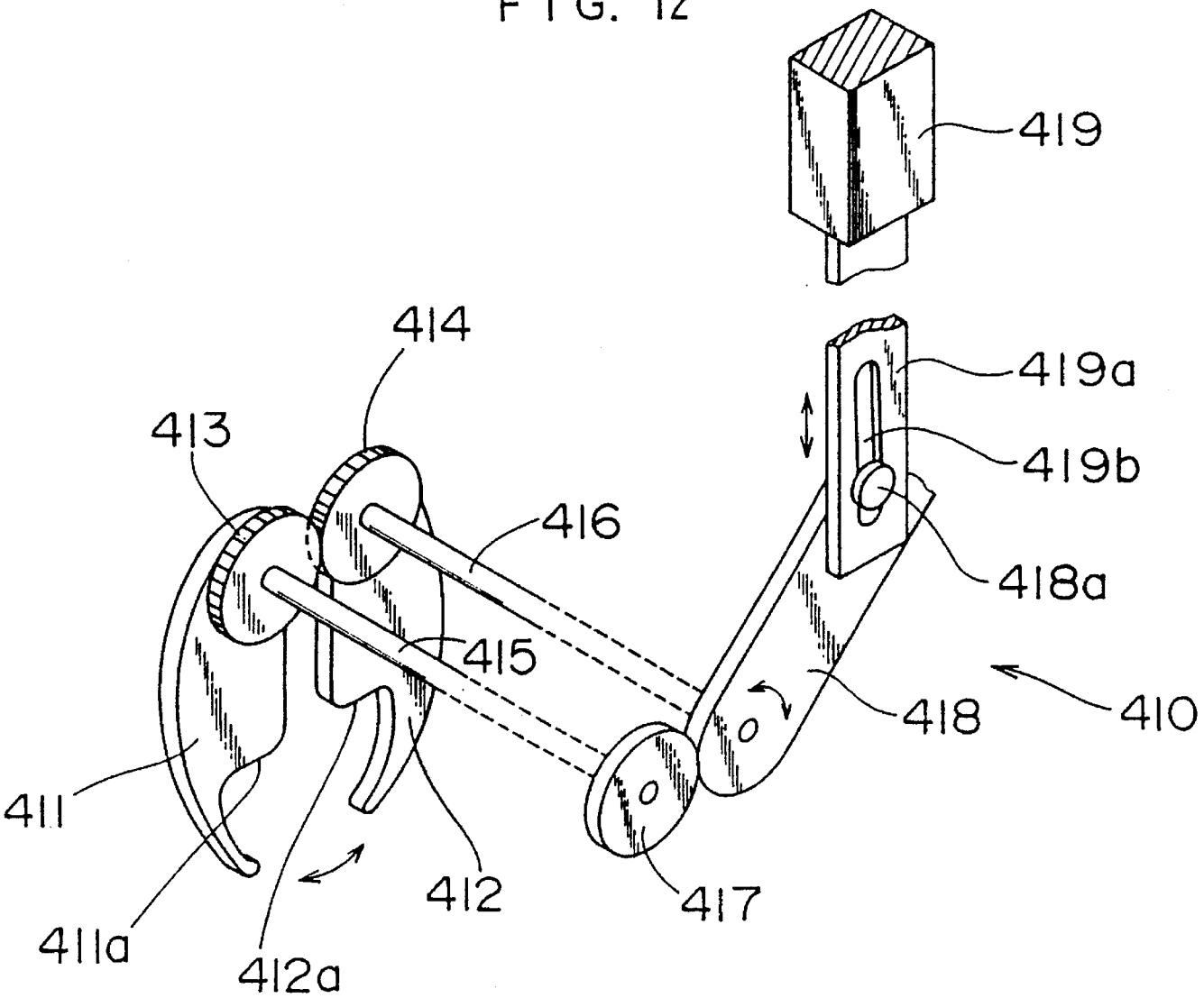
FIG. 12 is a schematic perspective view illustrating the electric wire bundle clamping mechanism.

Referring to FIG. 12 the respective electric wire bundle clamping mechanisms 410, 412 include 1) a pair of clamping members 411, 412, 2) spur gears 413, 414 connected rotatably to the respective clamping members 411, 412 and engaged with each other, 3) axial members 415, 416 fixing the respective spur gears at one end thereof and holding the respective spur gears 413, 414 rotatably to the frame 300, 4) a circular member 417 and a lever member 418 fixed to the other ends of these axial members 415, 416, respectively and 5) an air cylinder 419 holding a pin 418*a* formed on the tip end of the lever member 418 rotatably to the slit 419*b* at the lower end of a rod 419*a*.

Figure 10:
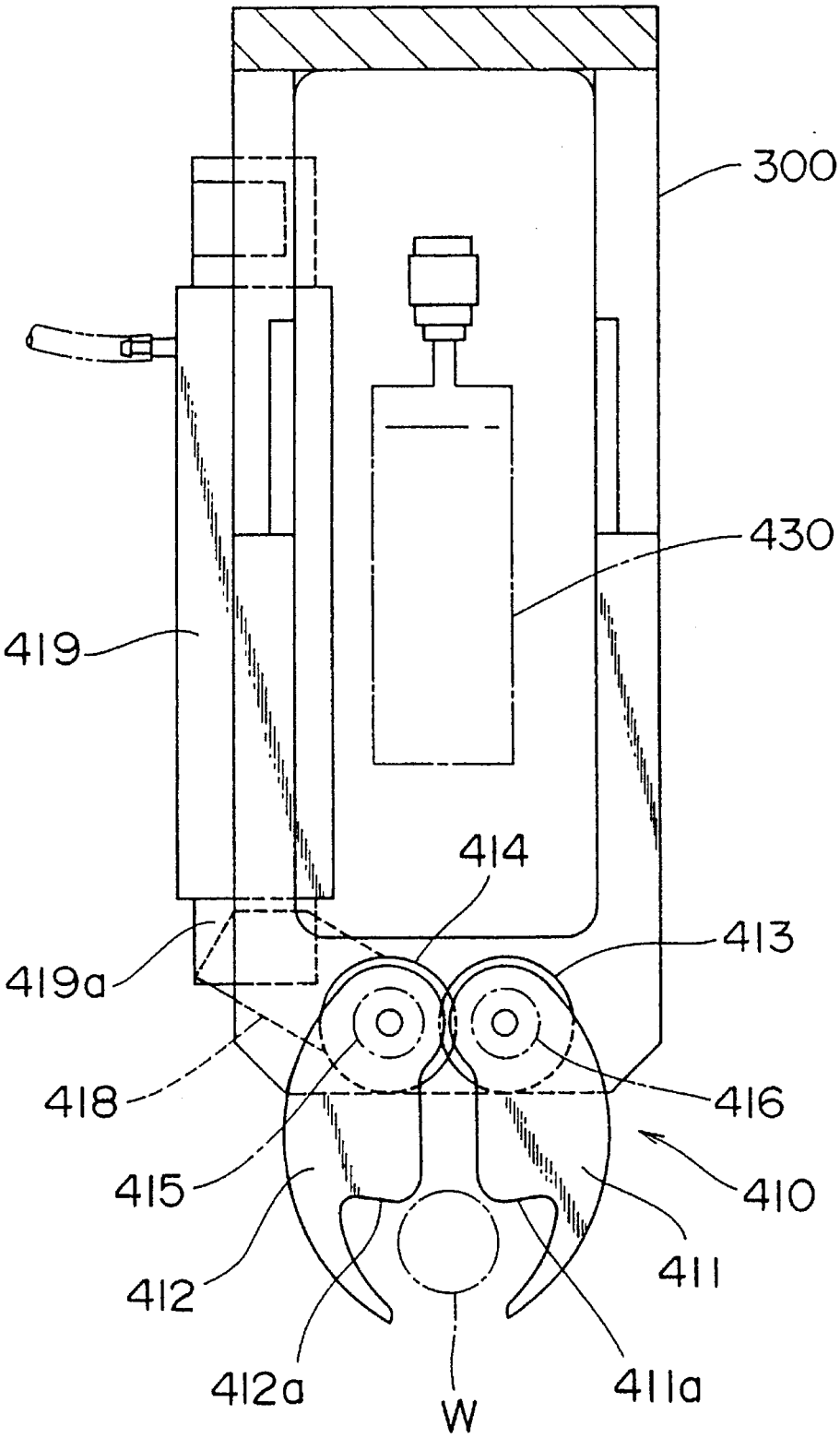
FIG. 10 is a schematic sectional view of the tape binding mechanism illustrating an electric wire bundle clamping mechanism seen frontally
Figure 11:
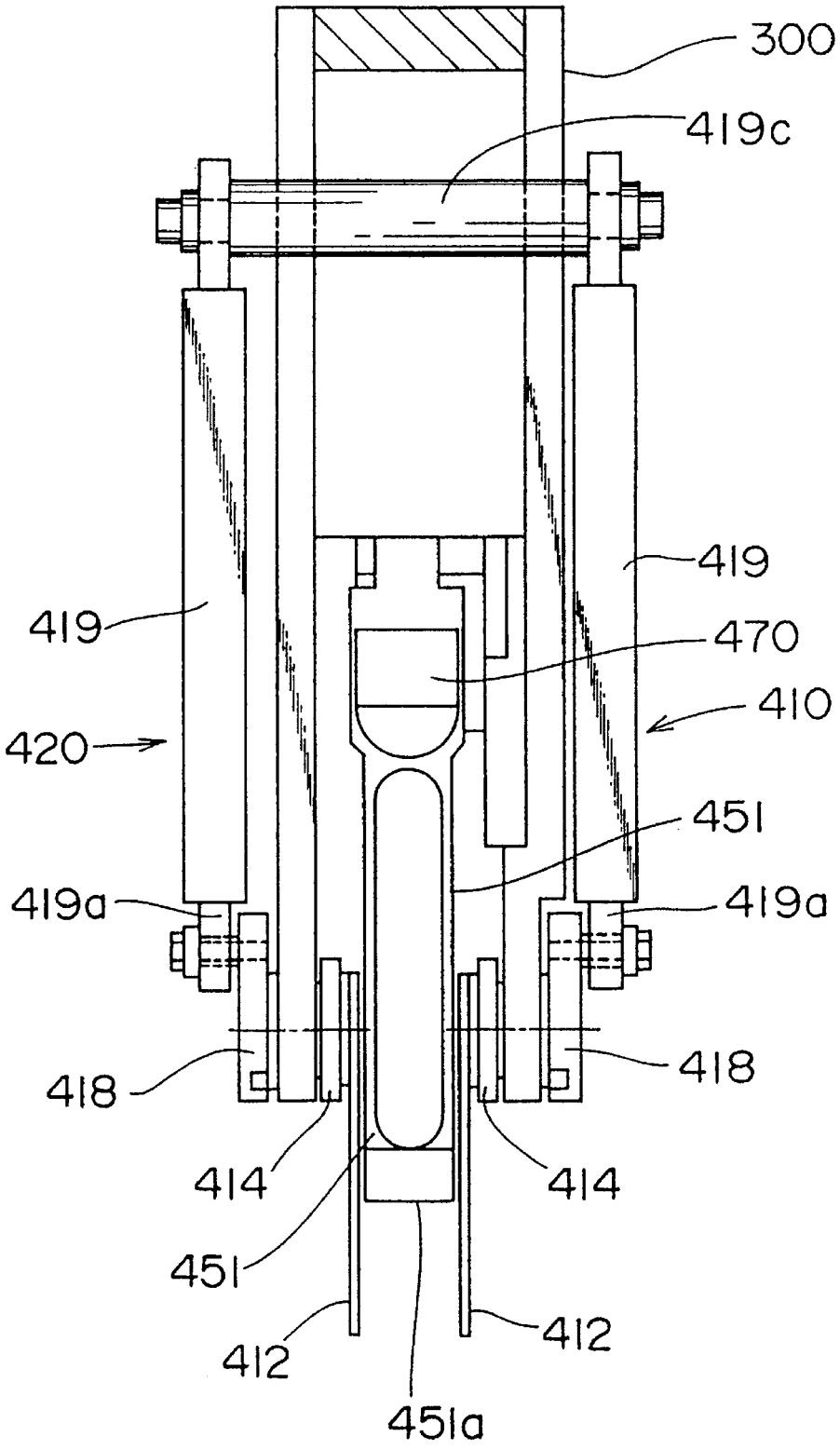
FIG. 11 is a schematic sectional view of the tape binding mechanism illustrating an electric wire bundle clamping mechanisms seen laterally.
Figure 13:
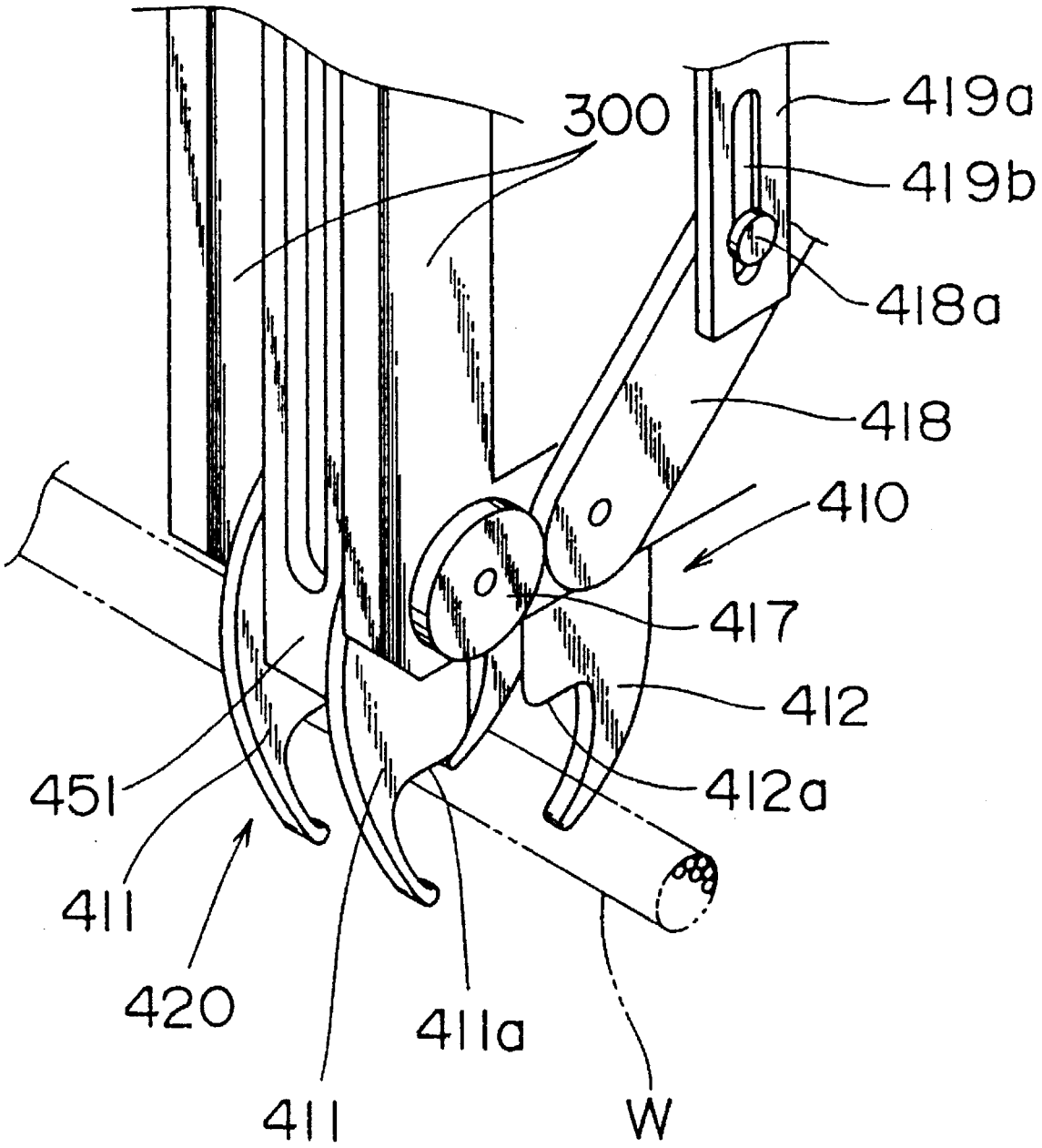
FIG. 13 is a schematic perspective view illustrating a state of the wire bundle clamping mechanism clamping an electric wire bundle.

The air cylinder 419 and the axial members 415, 416 are, as shown in FIGS. 11 and 12, supported by means of the frame 300. Further, as shown in FIGS. 10, 12 and 13, the pair of clamping members 411, 412 are provided with positioning surfaces 411*a*, 412*a* for positioning the upper end of the electric wire bundle W to a predetermined location when clamping the electric wire bundle W. The positioning surfaces 411*a*, 412*a* are, as shown in FIG. 10, formed into an circular arc surface centering on the axial members 415, 416.

In these electric wire bundle clamping mechanisms 410, 420, the distance between both clamping members 411, 412 is narrowed by extending the rod 418 to clamp the electric wire bundle W, as shown in FIG. 13.

Both upper ends of the air cylinder 419 of the respective electric wire bundle clamping mechanisms 410, 420 are connected together via a connecting rod 419*c*, as shown in FIG. 11.

Figure 8:
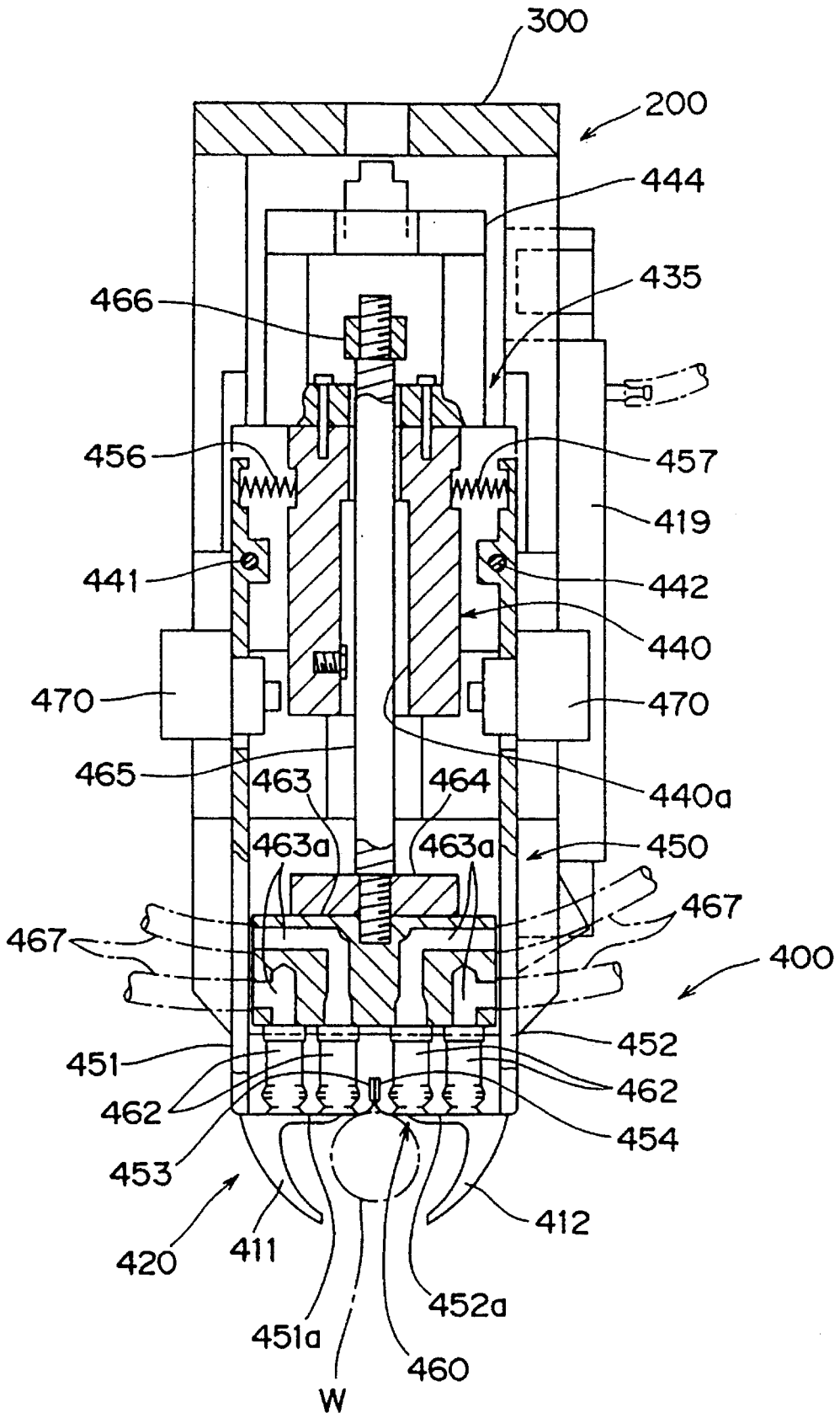
FIG. 8 is a partial sectional front view illustrating the tape binding mechanism.

Referring to FIG. 8, the lifting section 435 includes 1) a lifting section body 440, 2) an elastic pressing mechanism 450 including a pair of arms 451, 452 held rockably to the lifting section body 440, for pressing elastically the non-adhesive surface of the tape piece TT to wind it around the electric wire bundle W, 3) a tape piece holding mechanism 460 supported to the lifting section body 440 in a vertically movable way, for holding the tape piece TT on the lower surface of plate-like pressing sections 451*a*, 452*a* of the arms 451, 452 and 4) an air cylinder 470 as a distance adjusting mechanism for adjusting the distance between clipping members 453, 454 formed on the tip portion of the arms 451, 452.

Lifting Section Body

Figure 9:
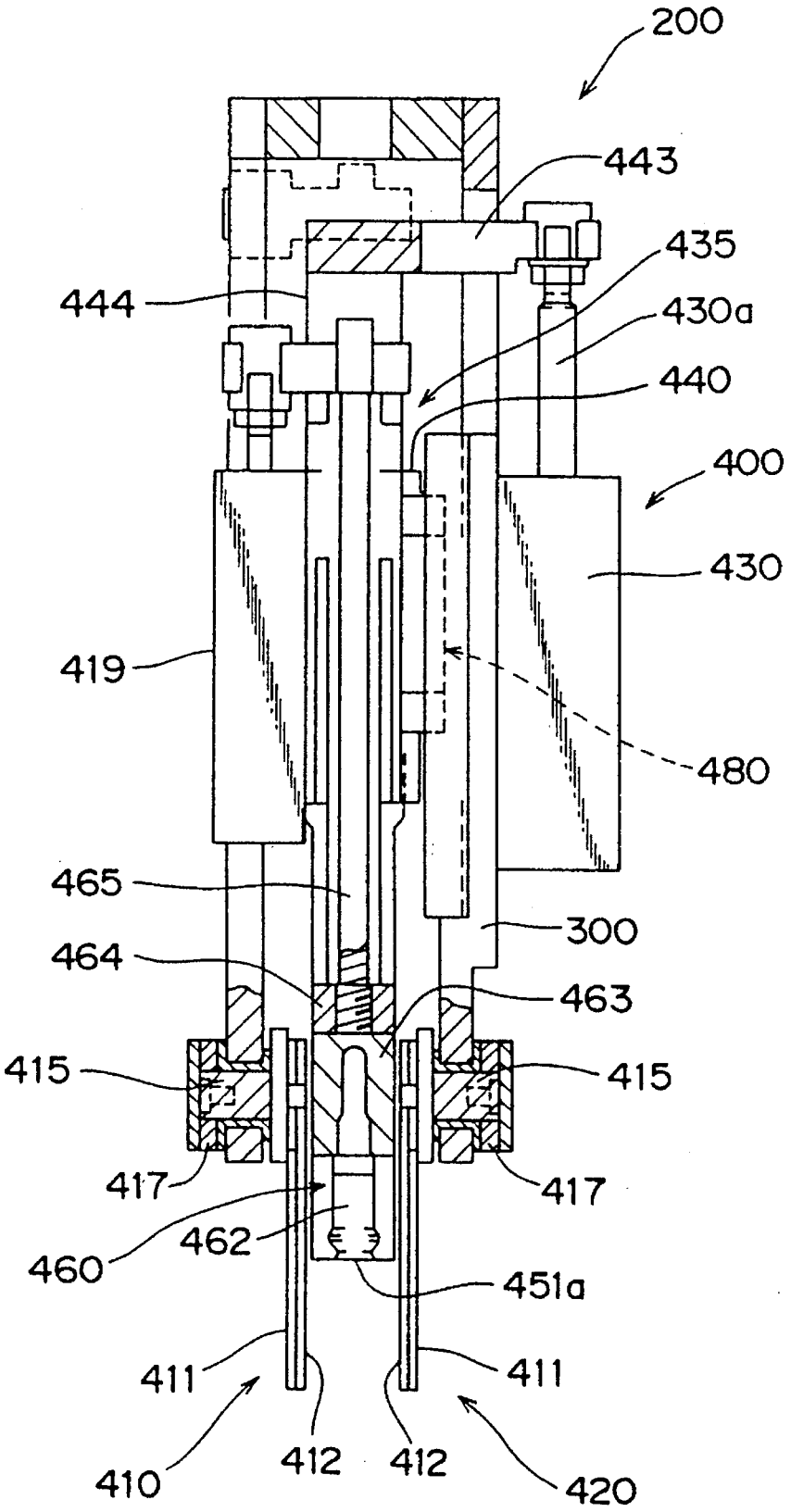
FIG. 9 is a partial sectional lateral view illustrating the tape binding mechanism.

Referring to FIG. 9, the lifting section body 440 is designed to be slid vertically via a slide rail mechanism 480 provided between the body and the frame 300. The lifting section body 440 is connected to the air cylinder 430 via the tip end of the rod 430*a* of the air cylinder 430, connecting lever 443 and the connecting frame 444, and is made to move vertically together with the stretching/shrinking of the rod 430*a* of the air cylinder 430.

The lifting section body 440 is, as shown in FIG. 8, provided with rod inserting hole 440*a* through which a rod 465 to be described later of the tape piece holding mechanism 460 is inserted in a vertically movable way.

Elastic Pressing Mechanism

Referring to FIG. 8, the elastic pressing mechanism 450 includes 1) a pair of mutually opposing L-shaped and reverse-L shaped arms 451, 452 supported rockably to the lifting section body 440 around pins 441, 442, 2) the plate-like pressing sections 451*a*, 452*a* included in the respective arms 451, 452 and composed of a leaf springs elastically pressing the tape piece TT to the electric wire bundle W, 3) the clipping members 453, 454 formed at the mutually opposing free end of the plate-like pressing sections 451*a*, 452*a* for embracing both ends of the tape piece TT at the lower portion of the electric wire bundle W to clip them and 4) compression coil springs 456, 457 as an elastic spring-loading means for spring-loading in the direction for reducing the distance between these clipping members 453, 454.

The holding surface for holding the tape piece is constituted with the lower surface of the plate-like pressing sections 451*a*, 452*a*.

Referring to FIG. 1, the base end section (lower end section) of the respective clipping members 453, 454 are bent at a curvature radius reverse to that of the circumferential surface of the electric wire bundle W.

In FIG. 8, the left arm 451 is spring-loaded in the counter-clockwise direction by means of the compression coil spring 456 and the right arm 452 is spring-loaded in the clockwise direction by means of the compression coil spring 457. Both clipping members 453, 454 are spring-loaded in the direction for mutually reducing the distance, by means of the operation of the compression coil springs 456, 457. Further, both clipping members 453, 454 contact each other at a predetermined pressing force when no external force is applied.

Tape Piece Holding Mechanism

Referring to FIG. 8, the tape piece holding mechanism 460 includes 1) a plurality of openings 461 formed respectively on the plate-like pressing sections 451*a*, 452*a* of the arms 451, 452 (see FIG. 1), 2) a flexible tube 462 of which lower part is connected to the respective openings 461, 3) a joint 463 provided with an air channel 463*a* connected to the upper ends of the respective flexible tubes 462, 4) a rod 465 having a lower end with the joint 463 fixed by a nut 464, which is supported on the lifting section body 440 in a vertically movable way by inserting the rod inserting hole 440*a* of the lifting section body 440 and 5) a nut 466 fixed to the upper end of this rod 465, which prevents the rod 465 from coming out.

The openings 461 are connected with an air suction pump (not shown) via the air channel 463*a* and a hose 466. By sucking air through the openings 461, the tape piece can be held in the stretched state to the plate-like pressing sections 451*a*, 452*a* of the arms 451, 452.

Distance Adjusting Mechanism

The air cylinder 470 as a distance adjusting mechanism is mounted roughly at the center portion in the height direction of the respective arms 451, 452. The respective air cylinders 470 widen the distance between both clipping members 453, 454 by extending the rod to attach it to the side surface of the lifting section body 440. Thereby, the winding of the tape piece T around the electric wire bundle W is completed and it becomes possible to move the clipping members 453, 454 located at the downstream of the electric wire bundle W to the upstream of the electric wire bundle W without being interfered with the electric wire bundle W.

Action

Next, referring to FIGS. 14 to 21, the action of the tape binding device will be explained.

Figure 14:
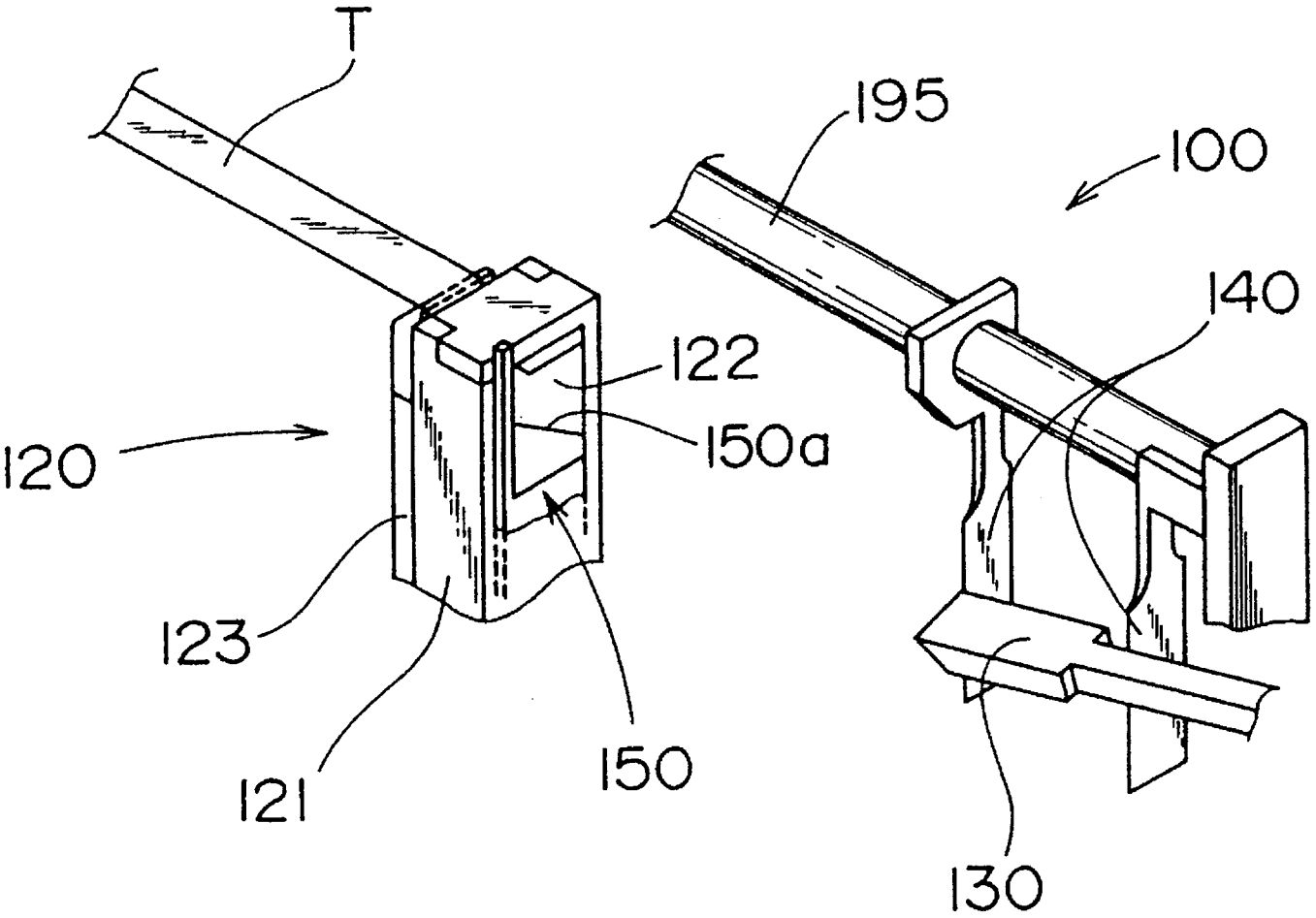
FIG. 14 is a schematic perspective view illustrating the tape piece supplying mechanism and a state of the tape clamping mechanism clamping the end of the tape.

As shown in FIG. 14, the tape binding mechanism 200 is located at the home position of the upstream of the tape piece supplying mechanism 110 and, at the downstream of this tape binding mechanism 200, the tape piece supplying mechanism 110 cuts the tape into tape pieces TT of the predetermined length according to the operations shown in FIGS. 14 to 18 to make them deliverable to arms 451, 452 of the tape binding mechanism 200.

Figure 15:
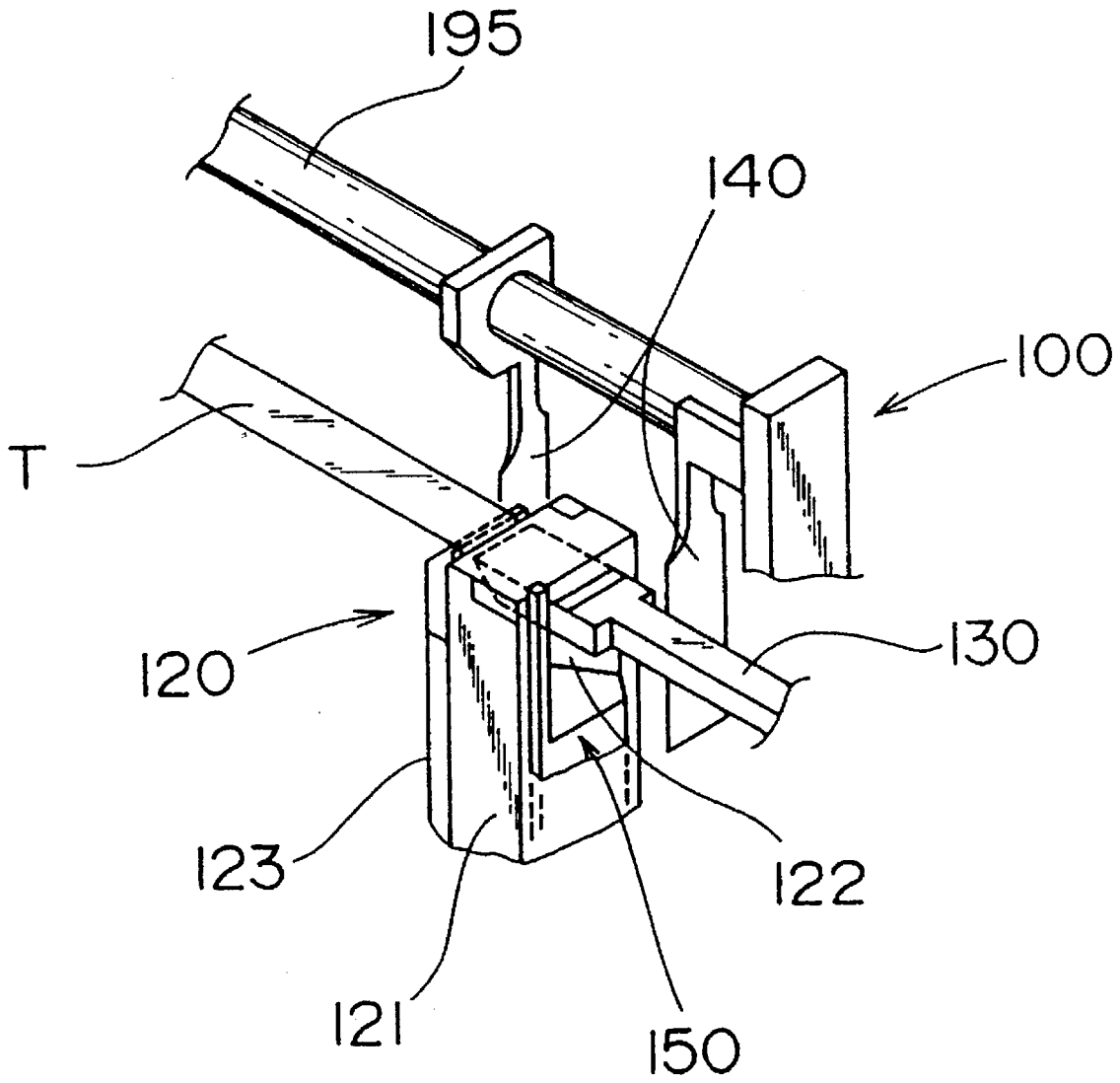
FIG. 15 is a schematic perspective view illustrating the tape piece supplying mechanism and a state of the tape clamping mechanism moving forward while clamping the end of the tape to hold the end of the tape onto a tape end holding member.
Figure 16:
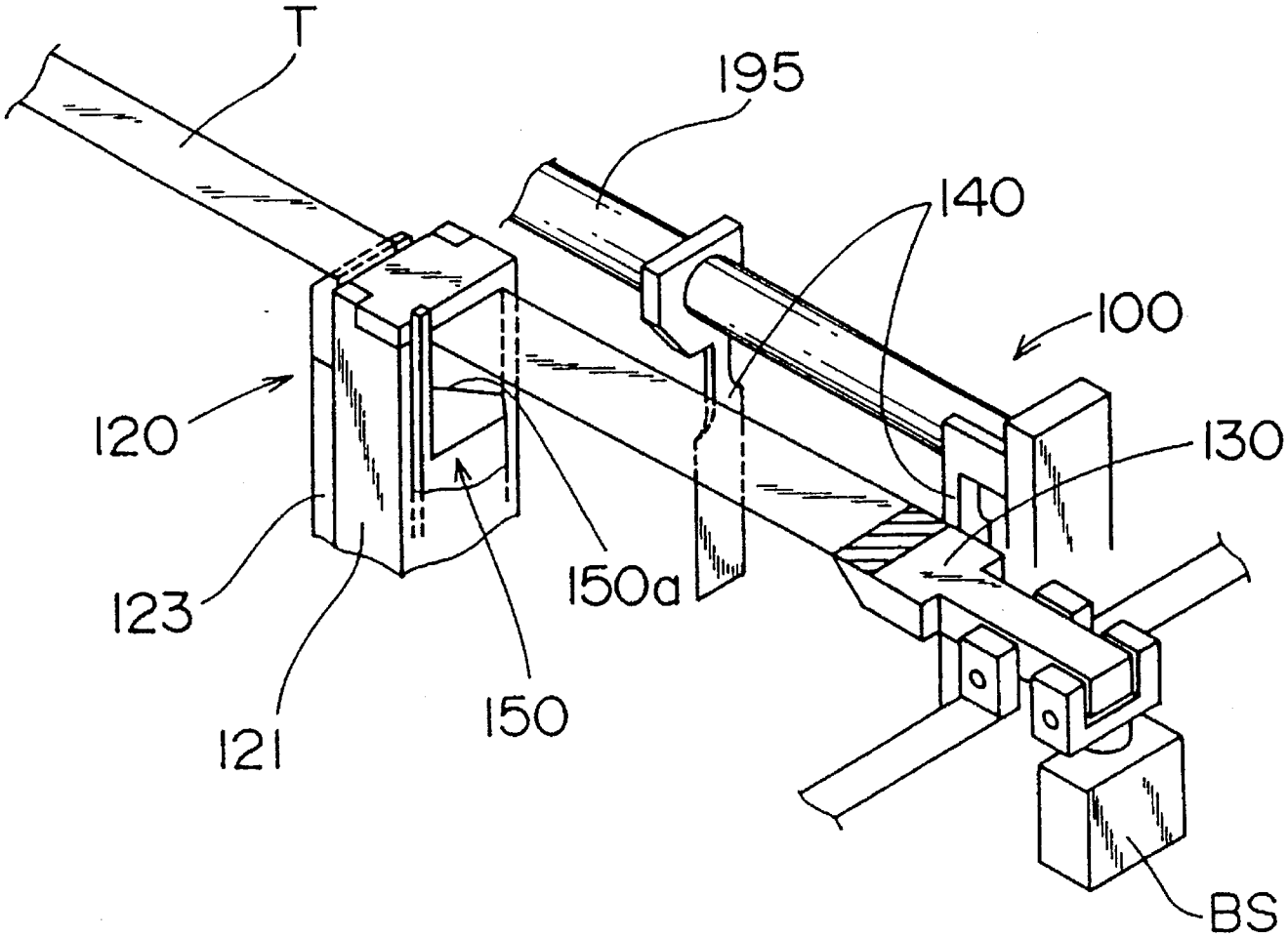
FIG. 16 is a schematic perspective view illustrating the tape piece supplying mechanism and a state where a tape having a predetermined length is applied after the tape clamping mechanism was moved backward.

Firstly, as shown in FIGS. 14 and 7B, the tape clamping mechanism 120 clamps the end of the tape T. In this clamped state, as shown in FIG. 15 the tape clamping mechanism 120 is moved forward and, at the same time, the tape end holding member 130 is inserted into the tape inserting hole 122 and is raised to the horizontal state. The raised tape end holding member 130 presses the ends of the tape T against the upper surface through the tape inserting hole 122, thereby adhering the adhesive surface of the tape T onto the tape end holding section 130*a* on the upper surface thereof.

Figure 17:
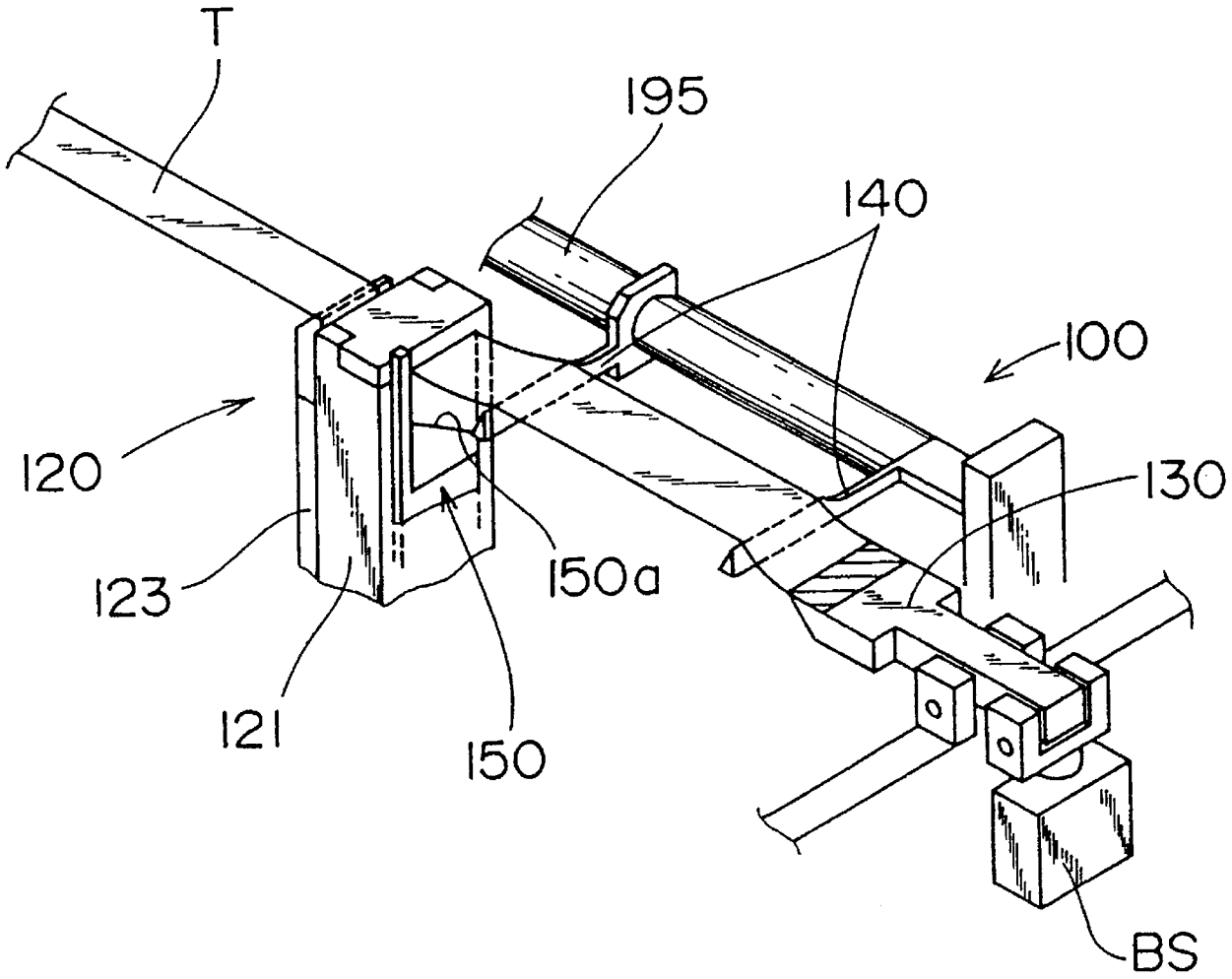
FIG. 17 is a schematic perspective view illustrating the tape piece supplying mechanism and a state of the applied tape held by a tape supporting member.

Thereafter, the tape clamping mechanism 120 moves backward in a predetermined stroke while unclamping the tape T (see FIG. 16) and clamps the tape T again at the location where it has moved backward, as shown in FIG. 17. Simultaneously, a pair of tape supporting members 140 are moved circularly to the horizontal state to hold the lower surface of the tape T.

Figure 18:
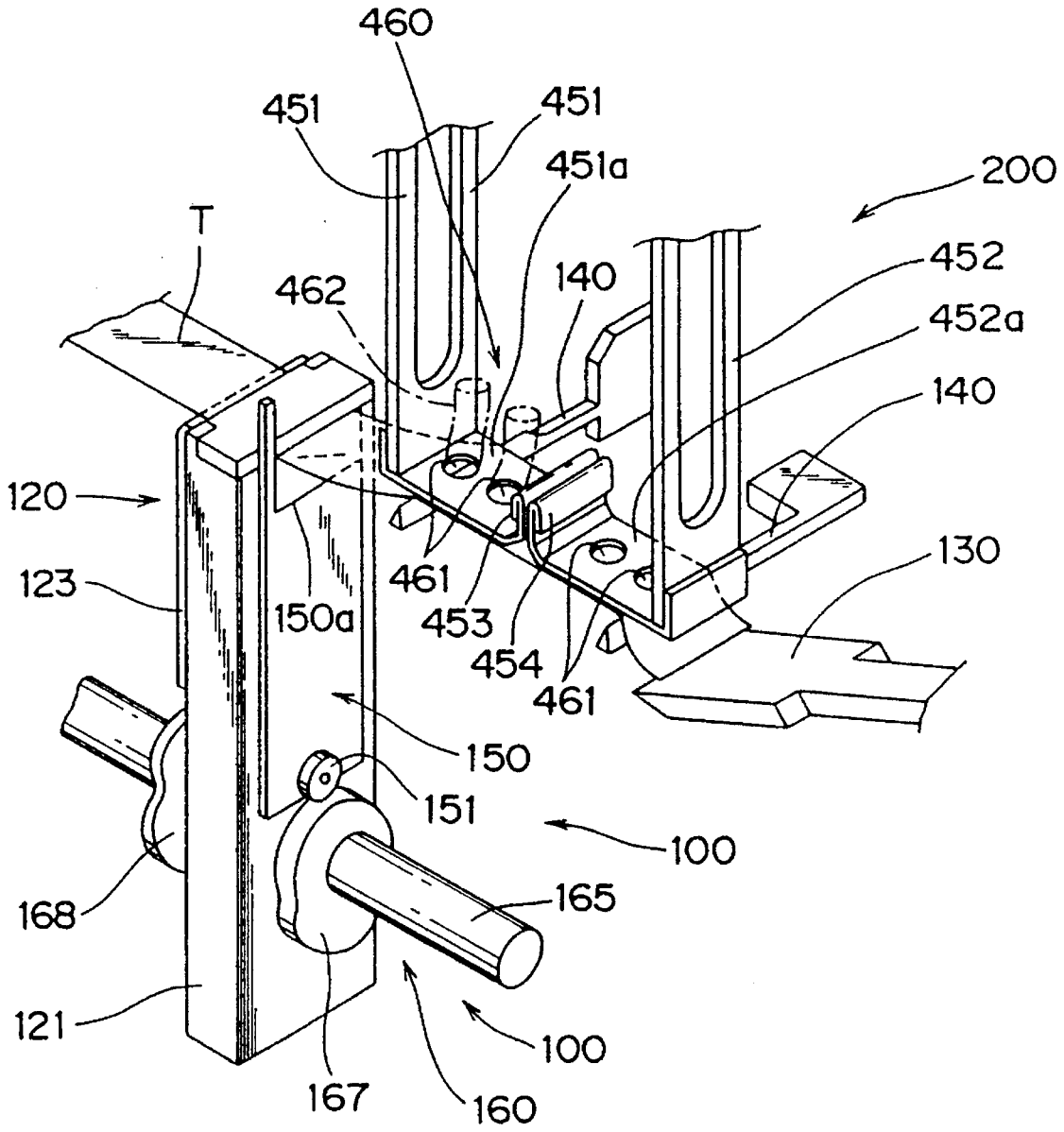
FIG. 18 is a schematic perspective view illustrating the tape piece supplying mechanism and the tape binding mechanism and a state where a tape piece cut to the predetermined length is adsorbed and held by means of arms of the tape binding mechanism.

Next, the arms 451,452 are lowered by the air cylinder 430 and, as shown in FIG. 18, contacts with the non-adhesive surface of the tape T and sucks to hold it. Then, the tape end holding member 130 inclines downward to release the holding of the end of the tape T. Simultaneously, the tape cutting member 150 is raised along with the side surface of the plate member 121 of the tape clamping mechanism 120 to cut the tape T. Since the tape supporting members 140 hold the tape piece TT at the stretched state, the plate-like pressing sections 451*a*, 452*a* of the arms 451, 452 can receive the tape piece TT in the stretched state.

The arms 451, 452 which have received the tape piece TT are raised by the air cylinder 430. Then, by means of the movement of the respective moving holders 44, 46 in the X- and Y-directions, they are moved to the upstream of a predetermined position on the wire lay-out board 9 where the tape will be wound and is directed in the required direction suitable for the direction of the electric wire bundle W by means of the rotation driving mechanism. Thereafter, the tape binding mechanism 200 is lowered by the movement of the Z-direction moving body, thus the bundling operation becomes ready. At this point, the electric wire bundle W is arranged between the clamping members 411, 412 of the electric wire bundle clamping mechanism 460 of the tape binding mechanism 200.

Figure 19:
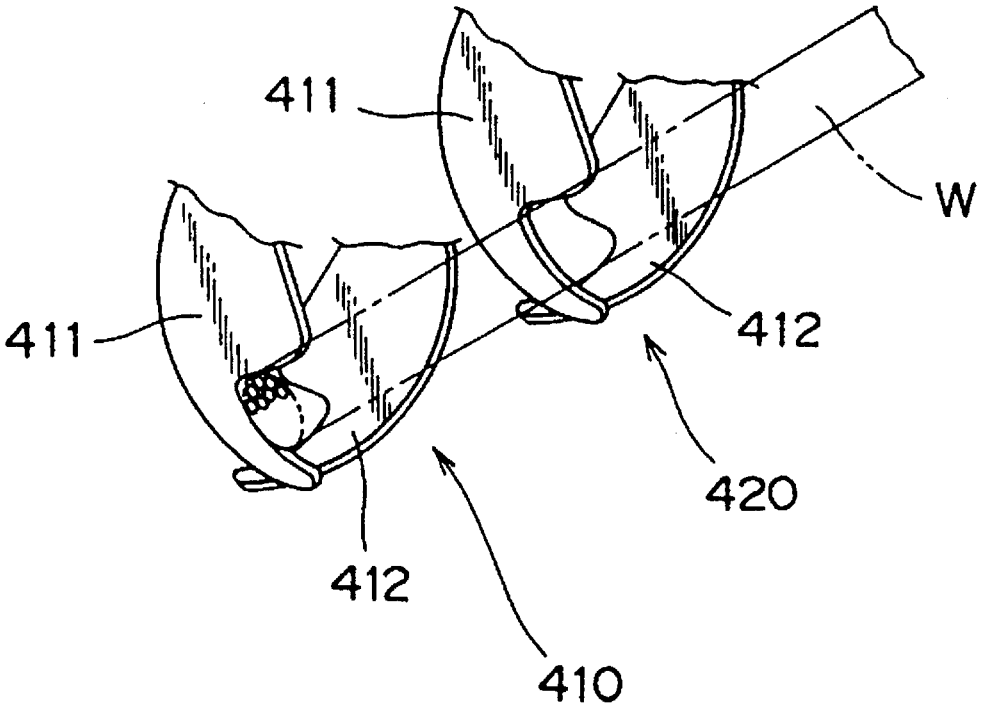
FIG. 19 is a schematic perspective view illustrating an electric wire bundle clamping mechanism and a state of the electric wire bundle clamping mechanism clamping the electric wire bundle.

Then, as shown in FIG. 19, a pair of electric wire bundle clamping mechanisms 460 collect the electric wire bundle W into approximately circular form in section by extending the air cylinder 419, using the clamping members 411, 412 to clamp them. Since a pair of the electric wire bundle clamping mechanisms 460 clips the portion of the electric wire bundle W where the tape piece TT will be wound and clamps a pair of locations with the predetermined distance apart respectively, the section of the electric wire bundle W located between both clapping mechanisms 460 is held firmly in the state collected in roughly circular form in section. Accordingly, it is possible to wind the tape piece TT at the predetermined position of the electric wire bundle W, precisely and without sagging. Incidentally, in FIG. 19, the arms 451, 452 are not shown.

Figure 20A:
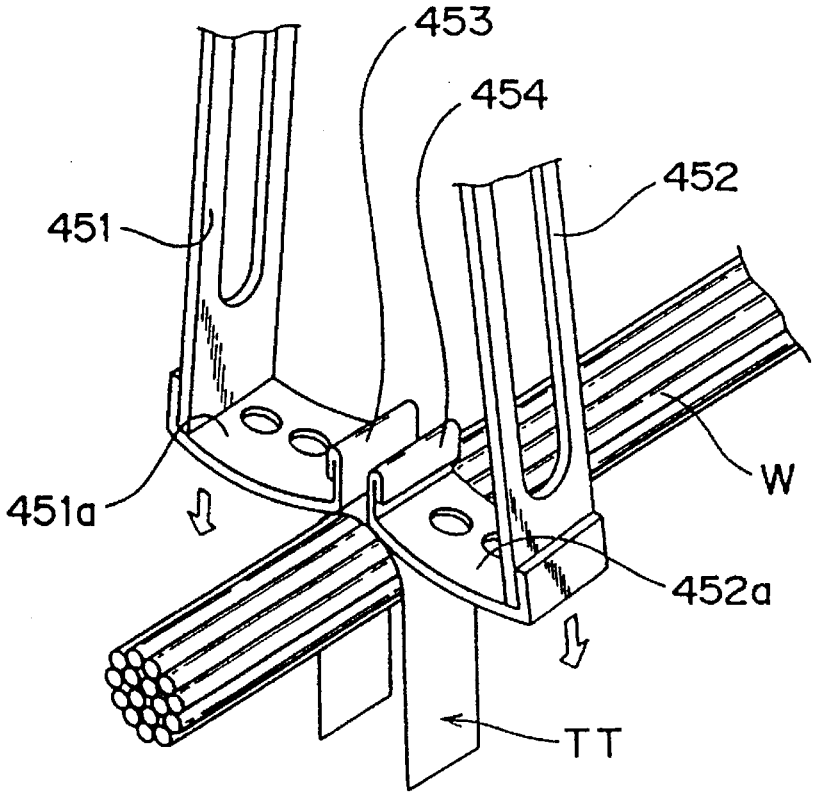
FIG. 20A illustrates a sate wherein the tape piece is pressed and wound around the electric wire bundle by means of a pair of arms and FIG. 20B illustrates a state wherein the ends of the tape pieces are laminated each other at the lower side of the electric wire bundle.
Figure 20B:
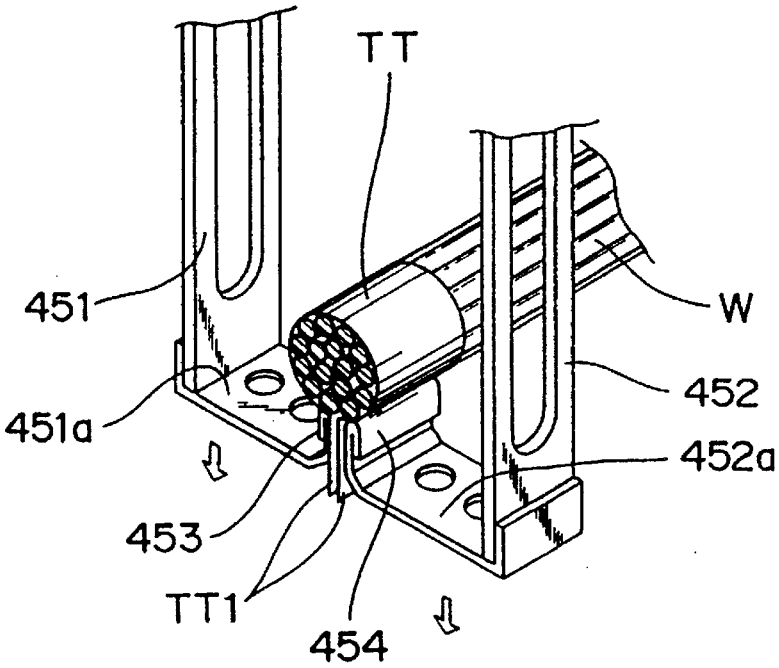
Figure 21:
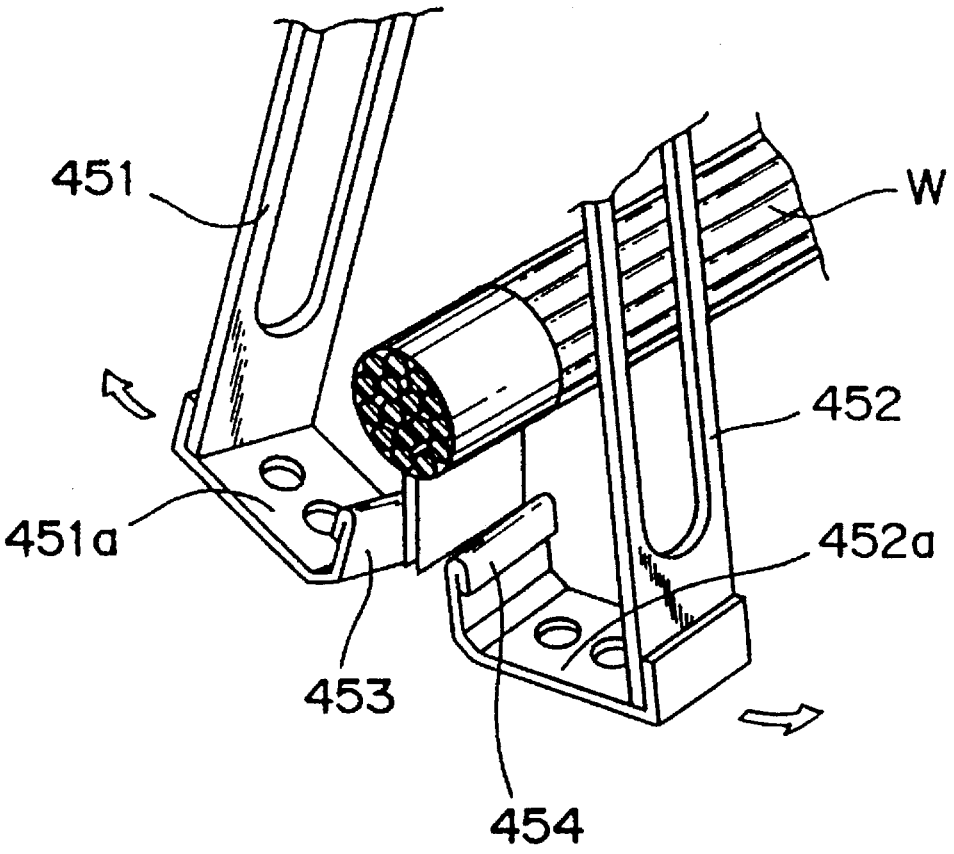
FIG. 21 is a schematic perspective view illustrating an action of the tape binding mechanism and a state wherein a pair of arms are opened out and left from the electric wire bundle.

Then, as shown in FIG. 20A, after winding the platelike pressing sections 451*a*, 452*a* of the arms 451, 452 finished winding the tape piece TT around the wire bundle W from the tip portion to both semicircular surfaces thereof by pressing with an uniform strength at right and left, the clipping sections 453, 454 at the end of the plate-like pressing sections 451*a*, 452*a*, as shown in FIG. 20B, clip tip ends TT1 of both tape piece TT as if to embrace them, and lower themselves while laminating them together at the downstream of the electric wire bundle W. Thereby, the bundling by means of the tape piece TT is completed, and both arms 451, 452 are expanded by means of the air cylinder 470 as a distance adjusting mechanism, as shown in FIG. 21 and, after the distance between the clipping sections 453, 454 were increased, the arms are raised by detouring the electric wire bundle W and leave the electric wire bundle W.

Then, the tape binding mechanism 200 including the arms 451, 452 returns to the home position of the upstream of the tape piece supplying mechanism 100 and, while the tape binding mechanism 200 is performing the winding operations, the tape piece supplying mechanism 100 simultaneously operates and the deliverable tape piece TT has already been prepared. Therefore, in the next bundling operation, as soon as the tape binding mechanism 200 returns to the home position, the operation to lower the arms 451, 452 to receive the tape piece TT (see FIG. 17) can be started. This is because the type supplying step for cutting and supplying the tape piece TT and the tape winding step for winding the tape piece TT around the electric wire bundle W can be conducted simultaneously by separately arranging the tape piece supplying mechanism 100 and the tape binding mechanism 200. Accordingly, the bundling operation can be conducted efficiently.

According to the above embodiment, since the arms 451, 452 holding the tape piece TT is lowered from the upstream of the electric wire bundle W to both sides of thereof to wind the tape piece TT around the electric wire bundle W, the winding can be conducted in a considerably narrow space in comparison with a conventional device wherein the bobbin is rotated. As a result, it becomes possible to tape the key portion of the electric wire bundle W laid out on the wire lay-out board 9, automatically.

Further, since the arms 451, 452 elastically press the tape piece TT around the electric Wire bundle W by means of the plate-like pressing sections 451*a*, 452*a* composed of a leaf spring, the tape piece TT can be wound tightly around the electric wire bundle W, thus precise and tight bundling can be performed.

Furthermore, since the clipping members 453, 454 for laminating both ends of the tape piece TT each other was formed on the free ends of the plate-like pressing sections 451*a*, 452*a*, it is possible to transfer smoothly from the operation of pressing the tape piece TT onto the electric wire bundle W to the operation of clipping the end of the tape piece TT at the downstream of the electric wire bundle W. Accordingly, the tape piece TT can be wound tightly around the electric wire bundle W, thus more precise bundling can be conducted.

And besides, since a loop around the electric wire bundle can be decreased by the tape piece TT as the pair of clipping sections 453, 454 are lowered in the state where both ends of the tape piece TT are clipped by embracing them at the downstream of the electric wire bundle W, thus more precise bundling can be conducted Moreover, since the rockably provided arms 451, 452 are shaped in the form of ladles, the clipping members 453, 454 can be slid into the lower side of the electric wire bundle W without requiring a vast space. Therefore, the tape winding can be conducted in a smaller space. Also, since the plate-like pressing sections 451*a*, 452*a* composed of a leaf spring have a reverse curvature against the curvature of the circular surface of the electric wire bundle W, both clipping members 453, 454 can be rapidly slid into lower side of the electric wire bundle W by making used of this repulsion force. As a result, the end portions TT1 of the tape piece TT can be clipped each other without sagging. Therefore, still more precise bundling can be conducted.

The present invention may be embodied in other specific forms without departing from the spirit or essential characteristics thereof. The present embodiment is therefore to be considered in all respects as illustrative and not restrictive, the scope of the present invention being indicated by the appended claims rather than by the foregoing description and all changes which come within the meaning and range of equivalency of the claims are therefore intended to be embrace therein.

What is claimed is:

1. A tape binding device for binding an electric wire bundle with a tape piece having one side with an adhesive surface and a side opposite the one side, said device comprising:

a device body;

a pair of arms provided vertically movable with respect to said device body, each of said arms having a mutually attachable/detachable free end, respectively;

a holding surface provided on each of said respective arms so as to be continuous with said free end thereof to hold the tape piece;

a biasing means for biasing said free end of each of said arms to bring said arms into contact with each other;

a tape piece holding means for holding the side opposite the one side of the tape piece to said holding surfaces of said arms with a predetermined holding strength; and an arm moving means for moving said arms vertically with respect to said device body.

2. A tape binding device according to claim 1, wherein each of said arms is L-shaped with said L-shaped arms facing each other in opposition;

wherein each of said arms has a first portion with a lower end, and a second portion which second portion is continuous with said lower end of said first portion;

wherein said second portion has a lower surface that provides said holding surface and said second portion includes said free end.

3. A tape binding device according to claim 2, wherein said first portion is composed of an elastic member and serves as said biasing means.

4. A tape binding device according to claim 2, wherein said second portion is a leaf spring.

5. A tape binding device according to claim 3, wherein said second portion is formed with an opening on said holding surface; and said means for holding said tape piece includes an air sucking means for sucking air through said opening, thereby holding said tape piece to said holding surface.

6. A tape binding device according to claim 1, further comprising a means for separating said pair of arms against said biasing means.

7. A tape binding device according to claim 1, wherein said holding surface is provided with an opening and said means for holding said tape piece includes an air sucking means for sucking air through said opening, thereby holding said tape piece to said holding surface.

8. A tape binding device according to claim 1, wherein said biasing means comprises a tension spring interposed between said pair of arms.

9. A tape binding device according to claim 1, further comprising a pair of electric wire bundle clamping means, provided on said device body, for collecting a pair of portions mutually separated by a predetermined distance from a portion of said electric wire bundle to be wound by said tape piece in a section having a roughly circular form so as to clamp said pair of portions respectively.

10. A tape binding device according to claim 1, further comprising a tape web cutting means for cutting a tape web laid out from a roll of said tape web; and a means for holding said tape piece cut with said tape web cutting means in a delivarable state to said holding surface of said arms.

11. A tape binding device according to claim 10, further comprising a device body moving means for moving said device body;

wherein said device body moving means moves to an upper position of said tape piece held by said means for holding said tape piece in said deliverable state, and an upper position of a place of said electric wire bundle laid on a wire lay-out board to be bound with said tape piece.

12. A tape binding device according to claim 1, further comprising a means for moving said device body to an upper position of a place where said electric wire bundle laid out on a wire lay-out board should be bound.

13. A tape binding method for use with an apparatus for binding an electric wire bundle with a tape piece having one side with an adhesive surface and a side opposite the one side, the apparatus including a device body, a pair of arms vertically movable with respect to the device body, each of the arms having a mutually attachable/detachable free end and each of the arms having a holding surface to hold the tape piece, biasing means for biasing the free end of each arm to bring the arms into contact with each other, and tape piece holding means for holding the side opposite the one side of the tape piece to the holding surfaces of the arms with a predetermined holding strength, and arm moving means for moving the arms vertically with respect to the device body, said method comprising steps of:

using the biasing means to bias the arms of the apparatus together;

causing the tape piece holding means to cause the holding surfaces of the free ends of the arms to hold the side of the tape piece opposite the side with the adhesive surface, thereby placing the adhesive surface facing downward;

causing the arm moving means to lower the arms and the free ends thereof with respect to the device body and with respect to an electric wire bundle until the free ends become separated, against the bias of the biasing means, by a top portion of the electric wire bundle, wherein during the step of lowering the free ends, the free ends wrap the tape piece around the electric wire bundle while pressing the tape piece on the electric wire bundle; and causing the arm moving means to further lower the arms to adhere both ends of the tape piece under the electric wire bundle to laminate the adhesive surface of each end to each other.

14. A tape binding method according to claim 13, further comprising a step of cutting a tape web laid out from a roll of the tape web; and a step of delivering the tape piece obtained in the cutting step to the holding surfaces of both arms.

* * * * *